US007350623B2

(12) United States Patent
Kinoshita et al.

(10) Patent No.: US 7,350,623 B2
(45) Date of Patent: Apr. 1, 2008

(54) ELEVATOR DOOR APPARATUS

(75) Inventors: Tooru Kinoshita, Fuchu (JP); Seiichi Someya, Fuchu (JP); Satoshi Takasawa, Fuchu (JP); Shin Murakami, Fuchu (JP); Yoshinobu Ishikawa, Fuchu (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/471,667

(22) Filed: Jun. 21, 2006

(65) Prior Publication Data

US 2006/0243535 A1 Nov. 2, 2006

Related U.S. Application Data

(63) Continuation of application No. PCT/JP2005/006224, filed on Mar. 24, 2005.

(30) Foreign Application Priority Data

Mar. 26, 2004 (JP) ..... 2004-092951

(51) Int. Cl.
*B66B 13/12* (2006.01)

(52) U.S. Cl. ..... 187/330; 187/319

(58) Field of Classification Search ..... 187/319, 187/330

See application file for complete search history.

(56) References Cited

U.S. PATENT DOCUMENTS 3,189,658 A * 6/1965 Quinn ..... 585/844
5,950,766 A * 9/1999 Oberleitner ..... 187/330
6,164,417 A * 12/2000 Oberleitner ..... 187/319
6,220,396 B1 * 4/2001 Heath, III ..... 187/335
6,340,073 B1 1/2002 Lee et al.
6,446,759 B1 * 9/2002 Kulak et al. ..... 187/330
6,508,332 B2 * 1/2003 Fahl et al. ..... 187/316
2004/0079593 A1 * 4/2004 Karner et al. ..... 187/330

FOREIGN PATENT DOCUMENTS

GB 1193933 6/1970

* cited by examiner

*Primary Examiner*—Peter M. Cuomo
*Assistant Examiner*—Eric E. Pico
(74) *Attorney, Agent, or Firm*—Foley & Lardner LLP

(57) ABSTRACT

An elevator door apparatus includes an engaging device which engages car doors with hall doors. The engaging device uses a spring unit to urge a movable vane provided in each of the car doors. While the doors are moving, engaging rollers supported by the hall doors are sandwiched between the movable vane and a fixed vane. Thus, the driving forces of the car doors are transmitted to the hall doors. When the hall doors reach a door stop position, the movable vane is moved away from the fixed vane. Thus, the car doors are disengaged from the hall doors. At this time, a direction in which the elastic force of the spring mechanism acts is switched. Consequently, the car doors and the hall doors are stably held so that the car doors remain disengaged from the hall doors.

9 Claims, 29 Drawing Sheets

ELEVATOR DOOR APPARATUS

CROSS REFERENCE TO RELATED APPLICATIONS

This is a Continuation Application of PCT Application No. PCT/JP2005/006224, filed Mar. 24, 2005, which was published under PCT Article 21(2) in English.

This application is based upon and claims the benefit of priority from prior Japanese Patent Application No. 2004-092951, filed Mar. 26, 2004, the entire contents of which are incorporated herein by reference.

BACKGROUND OF THE INVENTION

1. Field of the Invention

The present invention relates to an elevator door apparatus comprising an engaging device that engages a car door with a hall door.

2. Description of the Related Art

An elevator hall in a building is provided with an entrance to a car of an elevator. Hall doors, which are of sliding type, are attached to the entrance. The hall door is normally closed. When the car, moving through an elevator shaft, reaches a floor of the elevator hall, the hall door is opened and closed under the driving force of a car door of the car. The hall door also comprises a lock mechanism. The lock mechanism locks the hall door when it is closed. The lock mechanism unlocks the hall door when an operation of opening the hall door is started.

The car door comprises an engaging device used to open and close the hall door and to operate the lock mechanism. The engaging device comprises a pair of engaging vanes extending in a vertical direction. The engaging vanes vary the distance between themselves in accordance with the operation of the car door, while remaining parallel using parallel links.

The lock mechanism comprises two engaging rollers as engaging members used to operate a lock lever that locks the hall door. The two engaging rollers are interposed between the engaging vanes. The pair of engaging vanes sandwiches the engaging rollers between themselves to engage the car door with the hall door. As a result, the hall door can move in unison with the car door. Further, when the sandwiching of the engaging rollers between the engaging vanes is released, the lock lever is activated to lock the hall door.

When the hall door is closed to complete the activation of the lock mechanism of the hall door, the distance between the pair of engaging vanes increases up to a maximum value. As the result a gap is created between the engaging rollers and each engaging vane. Consequently, the car can move through the elevator shaft while preventing the engaging vanes from colliding against the engaging rollers.

Various engaging apparatus have already been proposed. For example, an engaging apparatus comprises a pair of engaging vanes, a cam roller, and a cam plate. The pair of engaging vanes constitutes a parallelogrammic link. The cam roller is attached to one of the engaging vanes. The cam plate is provided above the car door. The cam roller is guided to the cam plate as the car door is closed. When the cam roller moves up or down along the cam plate immediately before the hall door is closed, the distance between the pair of engaging vanes changes. As a result, the lock mechanism is activated or the car door and the hall door are disengaged from each other.

In an engaging device in another form, one of the pair of engaging vanes is fixed to the car door. Only the other engaging vane constitutes a parallelogrammic link mechanism. A cam roller is attached to the latter engaging vane. The cam roller is guided along a cam plate provided above the car door. The cam roller activates the lock mechanism and releases the engagement immediately before the car door is closed as described above.

To allow the car to move while the doors are completely closed, it is necessary to disengage the doors from each other. With an engaging device comprising a cam mechanism composed of a cam roller and a cam plate as described above, immediately before the door is closed, a gap is created between each engaging vane and the corresponding engaging roller. This blocks the transmission of the driving force from the engaging vane to the engaging roller. The hall door is operated under the force of a door closer that utilizes a weight or a spring from immediately before the door starts to be closed until it is completely closed.

There is an engaging device that disengages the car door and the hall door from each other without using a cam mechanism such as the one described above. This device comprises two support levers connected to the engaging vanes to constitute a parallelogrammic link mechanism. One of the support levers is supported so as to be rotatable around a pivot fixed to the car door. The pivot is connected to a door driving rope via an operation lever. The rope is pulled even after the hall door has been closed. The traction force of the rope is transmitted to a separately provided parallelogrammic link mechanism. The lock mechanism is thus activated to disengage the car door and the hall door from each other.

Another device does not use any cam mechanism. In this device, one of the engaging vanes can slide to and from the car door. The other engaging vane is connected to car door and a car door driving belt by rotatably supported levers. The levers operate to close the hall door. Moreover, even after the car door has been closed, the driving belt continues to be pulled in the direction in which the car door is closed. Thus, even after the car door has been closed, the doors can be disengaged from each other by driving only the engaging vanes. In such a door apparatus, the driving force is transmitted by the rope or belt not only while the door is being closed but also before the hall door is completely closed.

In particular, if there is a difference in temperature between an indoor area and an outdoor area as in the case of winter, a strong ascending current occurs in the elevator shaft of the elevator in a high-rise building. Thus, a large difference in atmospheric pressure occurs between the elevator shaft and the hall. For example, there is no difference in atmospheric pressure at the hall door of an elevator provided near an entrance of the first floor of the building while the door is open.

However, as the door is closed, the flow of air is constricted. Immediately before the door is closed, the difference in pressure between the elevator shaft and the hall increases rapidly. As the wind pressure acting in a direction from the hall to the interior of the elevator shaft increases, a heavier load is imposed on the guide device of the hall door. As a result, there may occur an increase in the frictional resistance of the guide device or in the atmospheric pressure acting on a door stop surface. Consequently, the door may not be completely closed.

In particular, a smoke insulating door that can be more appropriately closed has recently been employed as a hall door also used as a fireproof facility. Accordingly, when the door is closed, the difference in atmospheric pressure increases between the interior of the elevator shaft and the hall. As a result, the tendency to suffer the above disadvantage has become more significant.

With the above door apparatus comprising the cam roller and the cam plate, the force of the door closer can be effectively enhanced in order to deal with the wind pressure. However, the size of a weight or a spring mechanism must be increased in order to enhance the driving force of the door closer. This affects a space in which the elevator is installed. Further, when the driving force of the door closer is enhanced, the driving force of the car door apparatus must also be increased. Consequently, the size of a driving device must be increased. Since a high-rise building comprises a plurality of elevators, it is economically disadvantageous to take the above measure for each of a large number of hall doors installed on each floor.

Further, the latter of the previously described door apparatuses has a very complicated mechanism and is thus difficult to regulate. Accordingly, this apparatus is also economically disadvantageous. Moreover, in this door apparatus, the positions of the car door and the driving rope or belt do not coincide with each other but vary relatively. Thus, if this door apparatus is applied to a center open door, it is necessary to have a mechanism used to operate a right and left doors in unison, in addition to the rope and belt. Disadvantageously, this further complicates the mechanism of the apparatus.

BRIEF SUMMARY OF THE INVENTION

An elevator door apparatus according to the present invention reliably closes a hall door by transmitting the driving force of a car door to the hall door until the hall door is completely closed and without the need to enhance the force of a door closer or to complicate an engaging device for the hall door and car door. It is another object of the present invention to provide an elevator door apparatus that can operate normally even if a high wind pressure acts on the hall door.

The elevator door apparatus comprises car doors, hall doors, a driving mechanism, a lock mechanism, and an engaging device. The car doors are of a sliding type and close an entrance of a car of an elevator. The hall doors are also of the sliding type and close an entrance of an elevator hall. The driving mechanism moves each of the car doors. The lock mechanism locks and closes each of the hall doors at the closed position. When the car reaches a floor of an elevator hall, the engaging device operates the car door to engage the car door with the hall door to transmit the driving forces of the car door to the hall door. Further, when the car door is disengaged from the hall door, the engaging device activates the lock mechanism. If the car door and the hall door move, in unison, in a direction in which the doors are closed, a leading edge of a door stop side of the hall door precedes a leading edge of a door stop side of the car door. Moreover, the engaging device comprises a first engaging member, a second engaging member, a fixed vane, a movable vane, a spring mechanism, and a cam mechanism. The first engaging member is provided in the hall door to transmit a driving force of the car door to the hall door. The second engaging member is also provided in the hall door. The second engaging member is displaced relative to the first engaging member to activate the lock mechanism. The fixed vane is fixed to the car door. The movable vane is supported by the car door via a link mechanism. The movable vane can be moved in a direction in which it approaches or leaves the fixed vane while keeping parallel to the fixed vane. When the car door and the hall door are to move in a direction in which they are closed, the movable vane maintains a relative position with the fixed vane so as to hold the second engaging member at a position where the lock mechanism is released. Further, when the hall doors abut against each other and are thus stopped, the movable vane moves parallel to the fixed vane to disengage from the first and second engaging members. This causes the movable vane to activate the lock mechanism to lock the hall door. If the movable vane is engaged with the first and second engaging members, the spring mechanism elastically urges the movable vane in which the engagement is maintained, to hold the movable vane at that position. If the movable vane has been disengaged from the first and second engaging members, the spring mechanism elastically urges the movable vane in which the engagement is released, to hold the movable vane at that position. If the car door is to move in a direction in which it is opened, the cam mechanism moves the movable vane parallel in association with this movement and against the spring mechanism. The cam mechanism thus places the movable vane at the position where it engages with the first and second engaging members.

The cam mechanism comprises a cam plate and a cam roller. The cam plate is provided in a frame of the car door. The cam roller moves integrally with the movable vane. The cam mechanism is configured so that the cam plate is out of contact with the cam roller if the engagement of the engaging device is released as the car door moves in the direction in which it is closed.

Further, the elevator door apparatus preferably comprises regulating means or attenuation applying means. If the car door has been closed to release the engaging device, the regulating means inhibits the movable vane from moving toward a side on which the engagement occurs. The attenuation applying means reduces the speed at which the movable vane is moved by the spring mechanism in a direction in which the movable vane approaches or leaves the fixed vane.

The spring mechanism comprises a first shaft, a second shaft, and a spring member. The first shaft is provided on the car door. The second shaft is provided on the link mechanism or the movable vane. The spring member elastically urges the first and second shafts in a direction in which the shafts move away from each other. In this case, the spring member is a helical compression member, a helical torsion spring, or a leaf spring.

With the elevator door apparatus according to the present invention, the driving force of the car door is transmitted to the hall door until the hall door is completely closed. Then, the hall door can be reliably closed by appropriately maintaining an automatic closing force until the hall door is completely closed and without the need to enhance the force of the door closer or to complicate the engaging device for the hall door and car door. Therefore, the hall door can be normally opened and closed even when a high wind pressure acts on the hall door.

DETAILED DESCRIPTION OF THE INVENTION

First Embodiment

Figure 1:
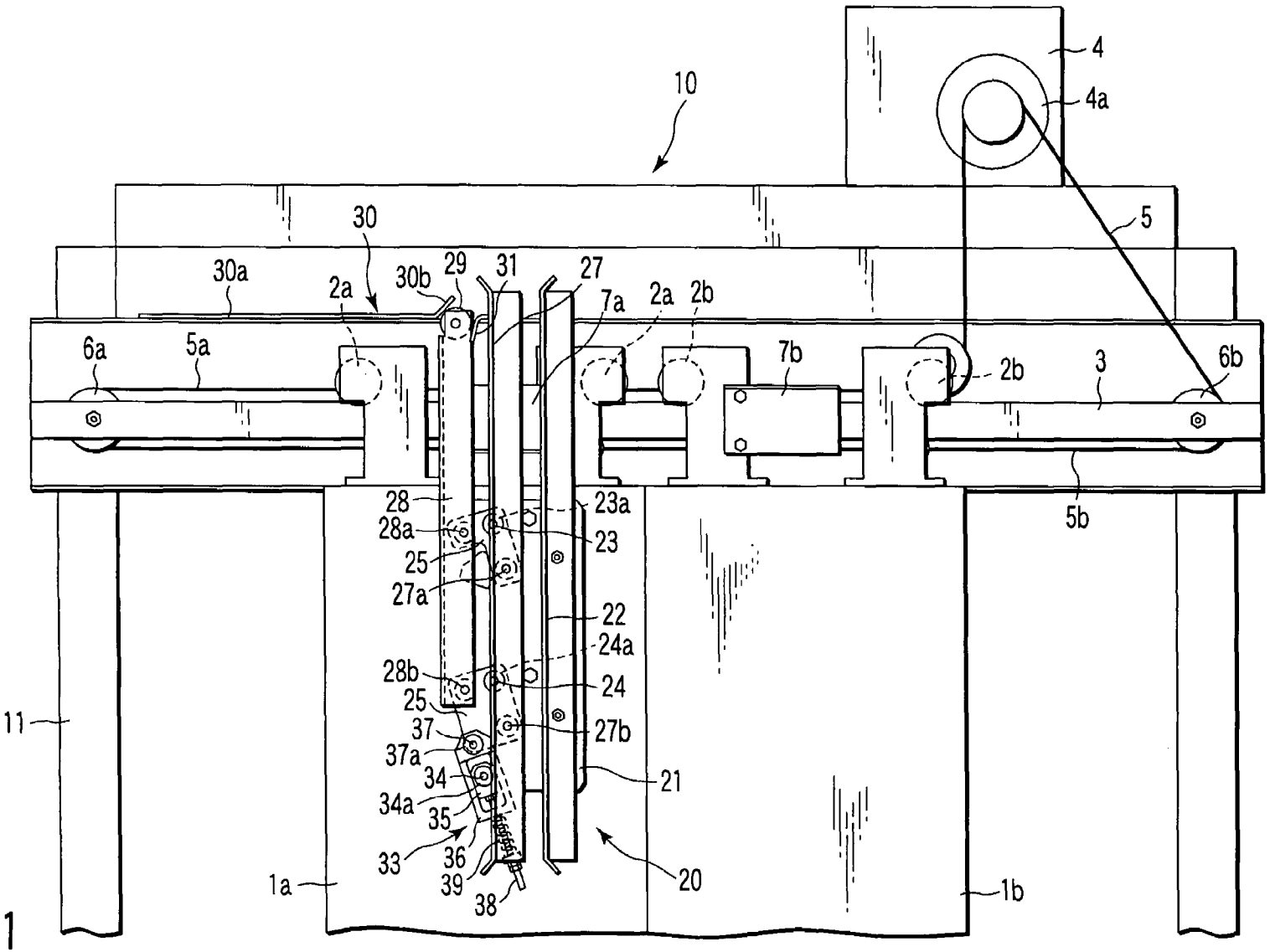
FIG. 1 is a front view of a car door of an elevator door apparatus according to a first embodiment of the present invention as viewed from a hall.

An elevator door apparatus 10 according to a first embodiment will be described with reference to FIGS. 1 to 11. The elevator door apparatus 10 comprises car doors 1*a* and 1*b*, hall doors 100*a* and 100*b*, a driving device 4, an engaging device 20, and a lock mechanism 101. FIG. 1 shows the center open type car doors 1*a* and 1*b* mounted at an entrance provided in the front of a car, as viewed from a hall. A frame member 11 is installed in the front of the car. A laterally elongated hanger rail 3 is attached to the top of the frame member 11 so as to extend in a horizontal direction. The car doors 1*a* and 1*b* have hanger roller 2*a* and 2*b*.

Hanger rollers 2*a* and 2*b* are provided on the top of paired car doors 1*a* and 1*b*. The car doors 1*a* and 1*b* are suspended from hanger rail 3 by using hanger rollers 2*a* and 2*b* so as to stand side by side. The car door 1*a* and 1*b* move in a lateral direction along the hanger rail 3 to open and close the entrance of the car.

A driving device 4 for the car doors 1*a* and 1*b* is provided above the frame member 11. Pulleys 6*a* and 6*b* are rotatably provided at the both end positions of the hanger rail 3. A car door driving belt 5 is passed around a sheave 4*a* of the device 4 and the pulleys 6*a* and 6*b* under an appropriate tension.

The middle of the driving belt 5 extends along and parallel to the hanger rail 3. The left car door 1*a* is connected to an upper part 5*a* of the driving belt 5 via a bracket 7*a*. The right car door 1*b* is connected to a lower part 5*b* of the driving belt 5 via a bracket 7*b*. The car doors 1*a* and 1*b* are thus joined directly to the one driving belt 5. Consequently, the car doors 1*a* and 1*b* move in unison and laterally symmetrically.

The engaging device 20 is attached to the car door 1*a*, located in the left of FIG. 1. The engaging device 20 causes the hall doors 100*a* and 100*b*, shown in FIG. 3, to move in unison with the car doors 1*a* and 1*b*. The car doors 1*a* and 1*b* constitute a car door apparatus together with the hanger rollers 2*a* and 2*b*, the hanger rail 3, the driving device 4, the driving belt 5, the pulleys 6*a* and 6*b*, brackets 7*a* and 7*b*, and the like. Similarly, the hall doors 100*a* and 100*b* constitute a hall door apparatus together with the lock mechanism 101 as well as a hanger rail, driving pulleys, a driving belt, and the like all of which are installed in the elevator hall.

The configuration of the engaging device 20 will be described below. The engaging device 20 comprises a base plate 21, a fixed vane 22, link plates 25 and 26, a movable vane 27, a cam support bar 28, a cam mechanism, and a spring unit 33. The base plate 21 is attached to the car door 1*a*. The fixed vane 22 has a vertically elongated L-shaped cross section and is fixed to the base plate 21.

The base plate 21 comprises shafts 23 and 24 at its upper and lower positions, respectively, the shafts 23 and 24 extending in a horizontal direction. The link plates 25 and 26 are rotationally movably assembled to the shafts 23 and 24 via bearings 23*a* and 24*a*, respectively. The movable vane 27 has an L-shaped cross section and is rotatably attached to one ends of the link plates 25 and 26 via shafts 27*a* and 27*b* from the shafts 23 and 24 as boundaries. The cam support bar 28 is rotationally movably attached to the other ends of the link plates 25 and 26 via shafts 28*a* and 28*b*, respectively. The movable vane 27 is assembled to the fixed vane 22 so as to lie parallel to and facing to the fixed vane 22 and to extend in a vertical direction. The cam support bar 28 is assembled to the movable vane 27 so as to lie parallel to the movable vane 27 and to extend in the vertical direction.

The link plates 25 and 26, the movable vane 27, and the cam support bar 28 constitute a parallelogrammic link mechanism. Further, a mechanical stopper 40 consisting of rubber or the like is attached to the base plate 21 in order to limit the rotational movement of the link plate 25 to a specified range.

The cam mechanism is composed of a cam roller 29 and a cam plate 30. The cam roller 29 is rotatably mounted at the top of the cam support bar 28. The cam roller 29 abuts against the cam plate 30 attached to the frame member 11. The cam plate 30 has a horizontal portion 30*a* that is a section extending in a horizontal direction, and an inclined portion 30*b* that extends obliquely upward from an end of the horizontal portion 30*a* which is closer to the center of the elevator door apparatus 10. Further, a cam stop portion 31 is provided away from and opposite the inclined portion 30*b* as a regulating mechanism.

Figure 2A:
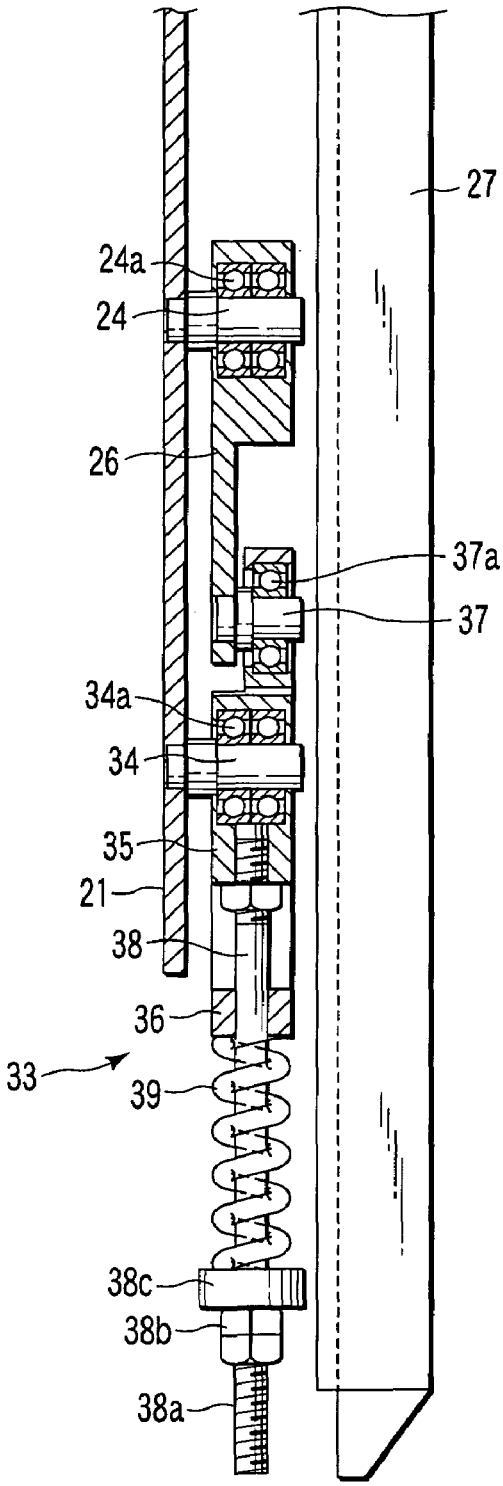
FIG. 2A is a sectional view of a spring unit provided in a car door shown in FIG. 1.
Figure 2B:
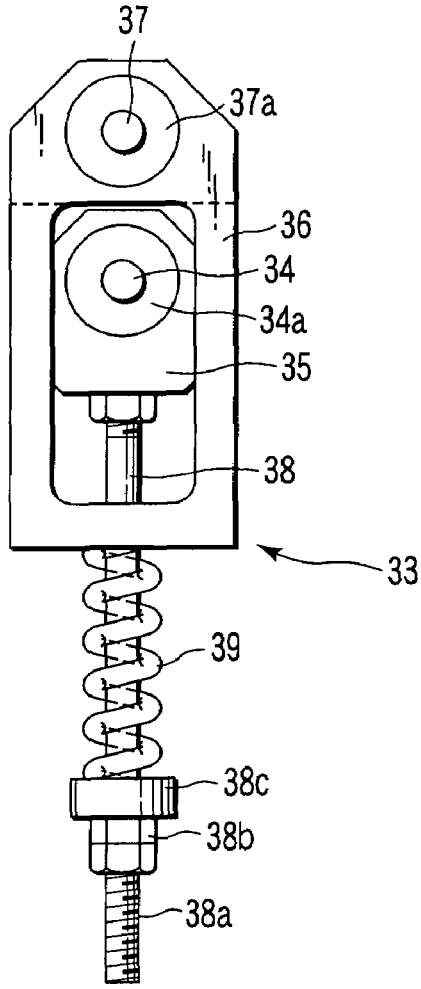
FIG. 2B is a front view of the spring unit shown in FIG. 2A.

A spring unit 33 serving as a spring mechanism is attached to the bottom of the link plate 26, located lower part of the apparatus. The spring unit 33 will be described with reference to FIGS. 1, 2A, and 2B. FIG. 2A is an enlarged sectional view of the spring unit 33. FIG. 2B is a front view of the spring unit 33. The spring unit 33 comprises a block 35, a block frame 36, a spring guide bar 38, and a compression spring 39.

The block 35 is rotatably assembled to the base plate 21 via a shaft 34 fixed to the base plate 21 and a bearing 34*a* installed on the shaft 34. The block frame 36 surrounds the block 35 and can slide with respect to the block 35. The top of the block frame 36 is rotatably connected to a shaft 37 via a bearing 37*a*. The shaft 37 is fixed to the bottom of the link plate 26.

The spring guide bar 38 is attached to the bottom of the block 35 and extends slidably downward through the block frame 36. The compression spring 39 is installed around the spring guide bar 38 projecting from the block frame 36. An external thread 38*a* is machined on a lower end of the spring guide bar 38. The compression spring 39 is assembled to a spring presser plate 38*c* and a nut 38*b* inserted around the external thread 38*a*, so as to be compressed by the spring presser plate 38*c* and nut 38*b*. The elastic force of the compression spring 39 urges the shaft 37, fixed to the link plate 26, away from the shaft 34, fixed to the base plate 21.

Figure 3:
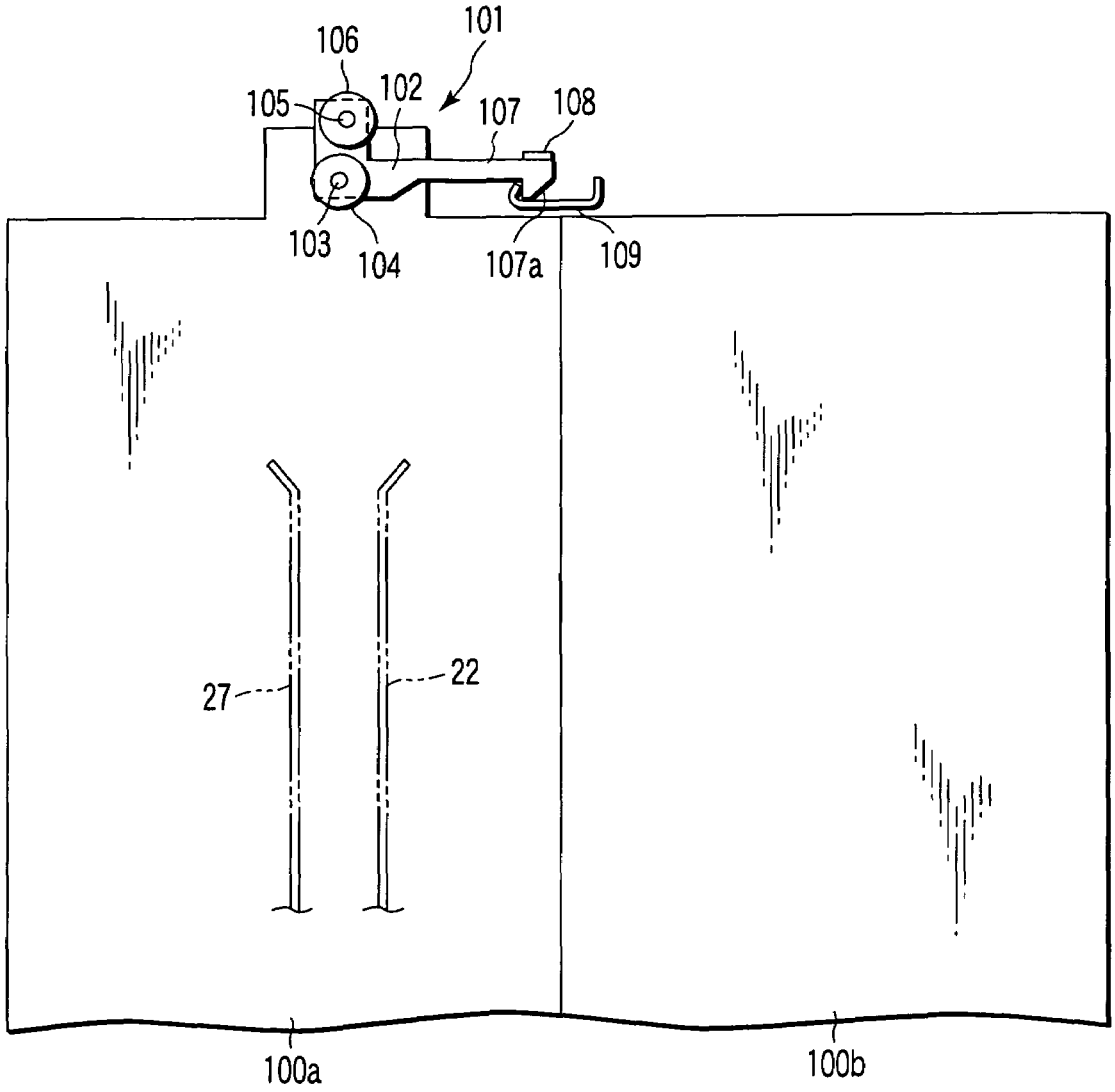
FIG. 3 is a front view of a lock mechanism provided in a hall door that engages with the car door shown in FIG. 1.

The hall door apparatus is shown in FIG. 3. The hall door apparatus comprises the pair of hall doors 100*a* and 100*b* and the lock mechanism 101. The hall doors 100*a* and 100*b* close the entrance of the elevator hall. The hall doors 100*a* and 100*b* are of a center open type in which they move laterally symmetrically in unison. The lock mechanism 101 is provided in the hall door 100*a*.

The lock mechanism 101 has a hook lever 102 bent in L form, a first engaging roller 104, and a second engaging roller 106. A bent portion of the hook lever 102 is rotationally movably attached to the hall door 100*a* via a shaft 103. The first engaging roller 104 is a first engaging member that transmits the driving force of the car door 1*a*. The first engaging roller 104 is rotatably attached to the bent portion of the hook lever 102 via the shaft 103. The second engaging roller 106 is a second engaging member that activates the lock mechanism 101. The second engaging roller 106 is rotatably attached, via a shaft 105, to an end of the hook lever 102 which is closer to the shaft 103. The second engaging roller 106 is located above the first engaging roller 104.

The other end of the hook lever 102 which is farther from the shaft 103 extends laterally from the first engaging roller 104 as an engaging piece 107. A key-like hook 107*a* is formed at a tip portion of the engaging piece 107. The hook lever 102 is urged by a weight 108 provided at the tip portion of the engaging piece 107, so as to move rotationally clockwise in FIG. 3. The hook lever 102 has its rotational movement range regulated by a stopper so that the engaging piece 107 substantially maintains its horizontal position.

The first engaging roller 104 and the second engaging roller 106 relatively enter the gap between the fixed vane 22 and the movable vane 27 in response to movement of the car. As shown in FIG. 3, an engaging portion 109 is provided on the frame member of the hall door apparatus so that the hook lever 102 can be engaged with and disengaged from the engaging portion 109.

With reference to FIGS. 4 to 8, description will be given of the operation of the present embodiment configured as described above. These figures are drawn so that the above arrangements are visible. The car door 1*a* is sequentially closed by the driving force of the driving device 4 in order of FIGS. 4 to 8. The shafts 23, 24, and 34, fixed to the car door 1*a* and the shaft 103, fixed to the hall door 100*a*, are illustrated by black spots.

Figure 4:
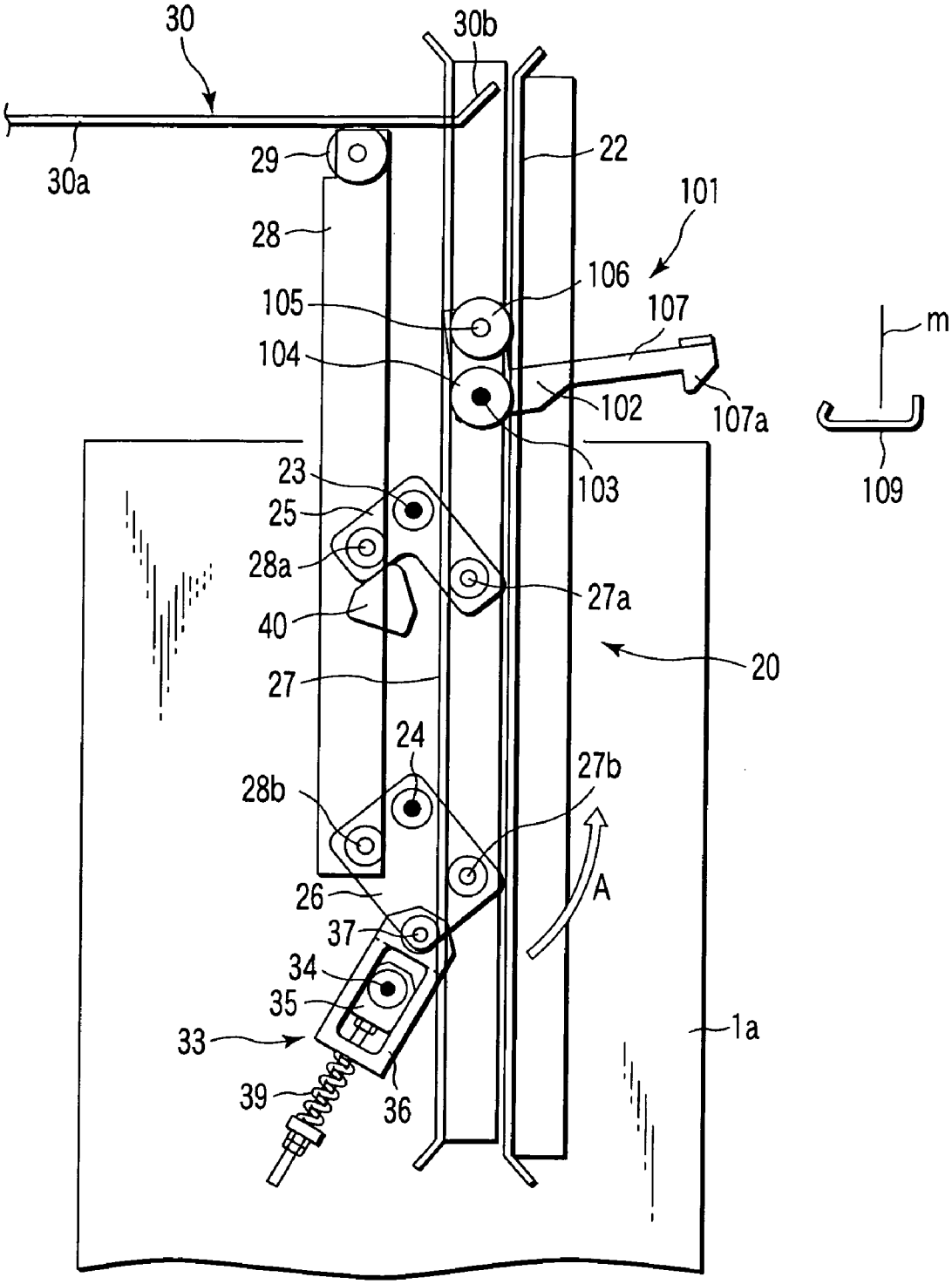
FIG. 4 is a diagram showing how an engaging device operates in a first stage in which the car door shown in FIG. 1 is being closed.

FIG. 4 shows how the elevator door apparatus 10 is being closed after the car has reached an elevator hall on a certain floor. The car door is superimposed on the hall door, which is thus not shown in the figure. In FIG. 4, the first engaging roller 104 and second engaging roller 106 of the lock mechanism 101 has entered the gap between the fixed vane 22 and movable vane 27 of the car door 1*a*. A line shown at m in FIGS. 4 to 8 indicates a door stop position observed when the car doors 1*a* and 1*b* are closed.

In this state, the elastic force of the compression spring 39 acts in a direction in which the shaft 37 is separated from the shaft 34. Consequently, the link plate 26 is elastically urged in a direction in which it moves rotationally counterclockwise in FIG. 4 as shown by arrow A. Thus, the other link plate 25, constituting the parallelogrammic link mechanism, is urged counterclockwise around the shaft 23. The link plate 25 abuts against the mechanical stopper 40, which is made of rubber and fixed to the base plate 21. The link plate 25 is thus stopped stably. Further, the cam roller 29 maintains a small gap between itself and the horizontal portion 30*a* of the cam plate 30.

The first engaging roller 104 and the second engaging roller 106 are sandwiched between and bound by the fixed vane 22 and the movable vane 27. Therefore, the car door 1*a* is engaged integrally with the hall door 100*a*, shown in FIG. 3. The engaging piece 107 of the hook lever 102 is inclined in such a manner that its tip portion is slightly raised. While the elevator door apparatus 10 is being moved in the direction in which it is closed, door stop edges of the hall doors 100*a* and 100*b* slightly precede door stop edges of the car doors 1*a* and 1*b* (for example, by a distance of 14 mm).

Figure 5:
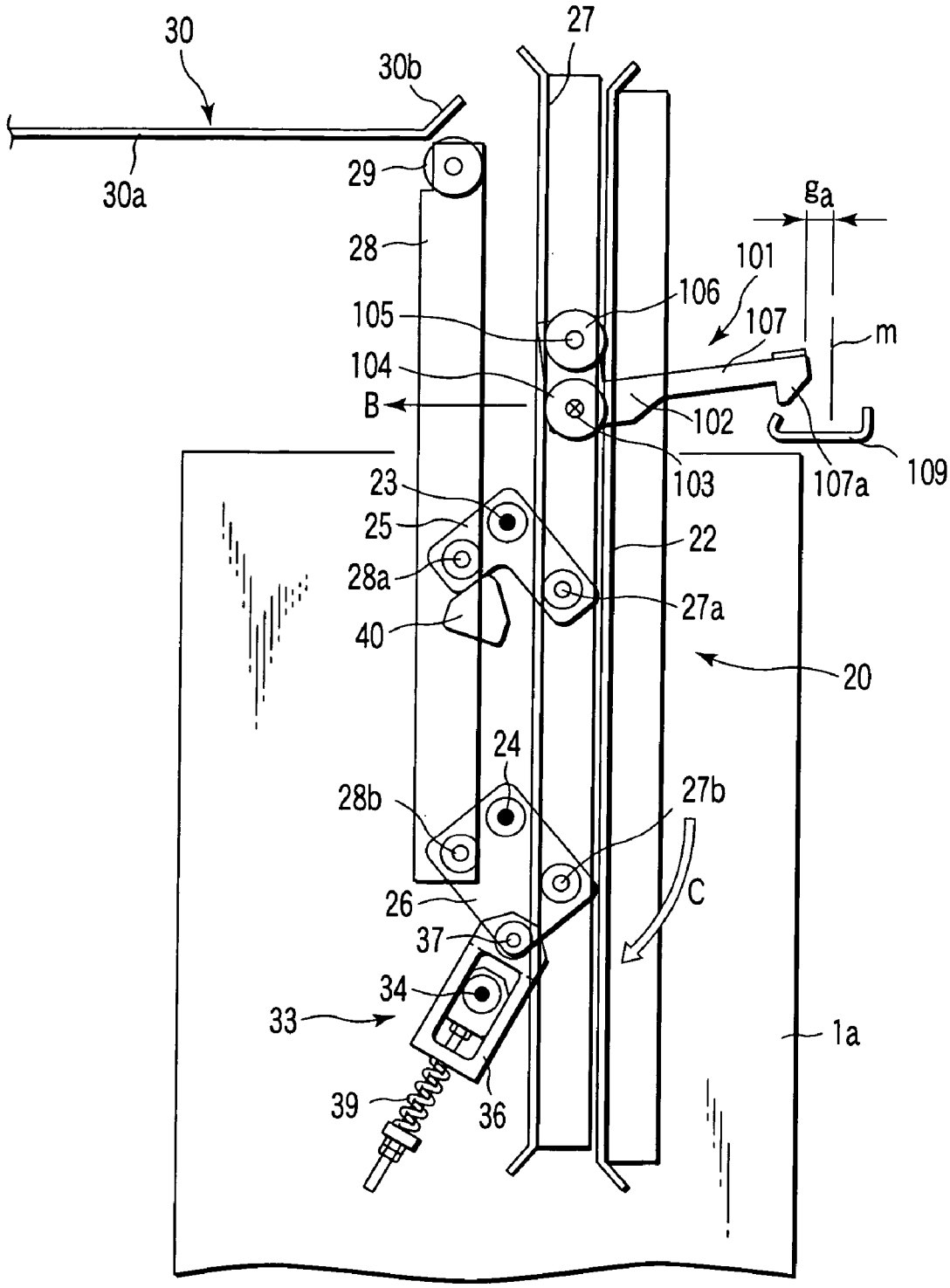
FIG. 5 is a diagram showing how the engaging device operates in a second stage in which the car door is further closed compared to the first stage shown in FIG. 4.

As the car door 1*a* moves in the direction in which it is closed, it reaches a position shown in FIG. 5. At this time, the hall doors 100*a* and 100*b* are already closed so that their door stop edges abut against each other. Further, the edge of the car door 1*a* is still at a short distance ga from the door stop position m. The moment the hall doors 100*a* and 100*b* abut against each other, the distance ga is 14 mm in the above dimensional case.

Once the state shown in FIG. 5 is established, the shaft 103 of the first engaging roller 104 is located at an immobile stopped position. Accordingly, when the car door 1*a* subsequently further moves in the door closing direction, the movable vane 27 is subjected, in response to this movement, to a reaction force from the engaging roller 104 which is at a stop, the reaction force acting in a direction shown by arrow B. The shaft 103 is shown with X in order to clearly show that the engaging roller 104 has been immobilized.

In the state shown in FIG. 5, when the car door 1*a* further moves in the closing direction, the shaft 103 is fixed. Thus the movable vane 27 is pushed back in a direction in which the movable vane 27 is separated from the fixed vane 22. The link plate 25 start to rotate around the shaft 23, and the link plate 26 start to rotate around the shaft 24, respectively in clockwise direction as shown by arrow C in FIG. 5 against the elastic force of the compression spring 39. The link plate 26 soon reaches a position shown in FIG. 6. On this occasion, the cam roller 29 and the horizontal portion 30*a* of the cam plate 30 are not in contact.

In this state, the distance between the fixed vane 22 and the movable vane 27 widens to unbind the engaging roller 106. Thus, the hook lever 102 moves rotationally clockwise around the shaft 103 together with the engaging roller 106. The hook 107*a* of the engaging piece 107 then engages with the engaging portion 109. This engagement causes the hall door to be locked.

Figure 6:
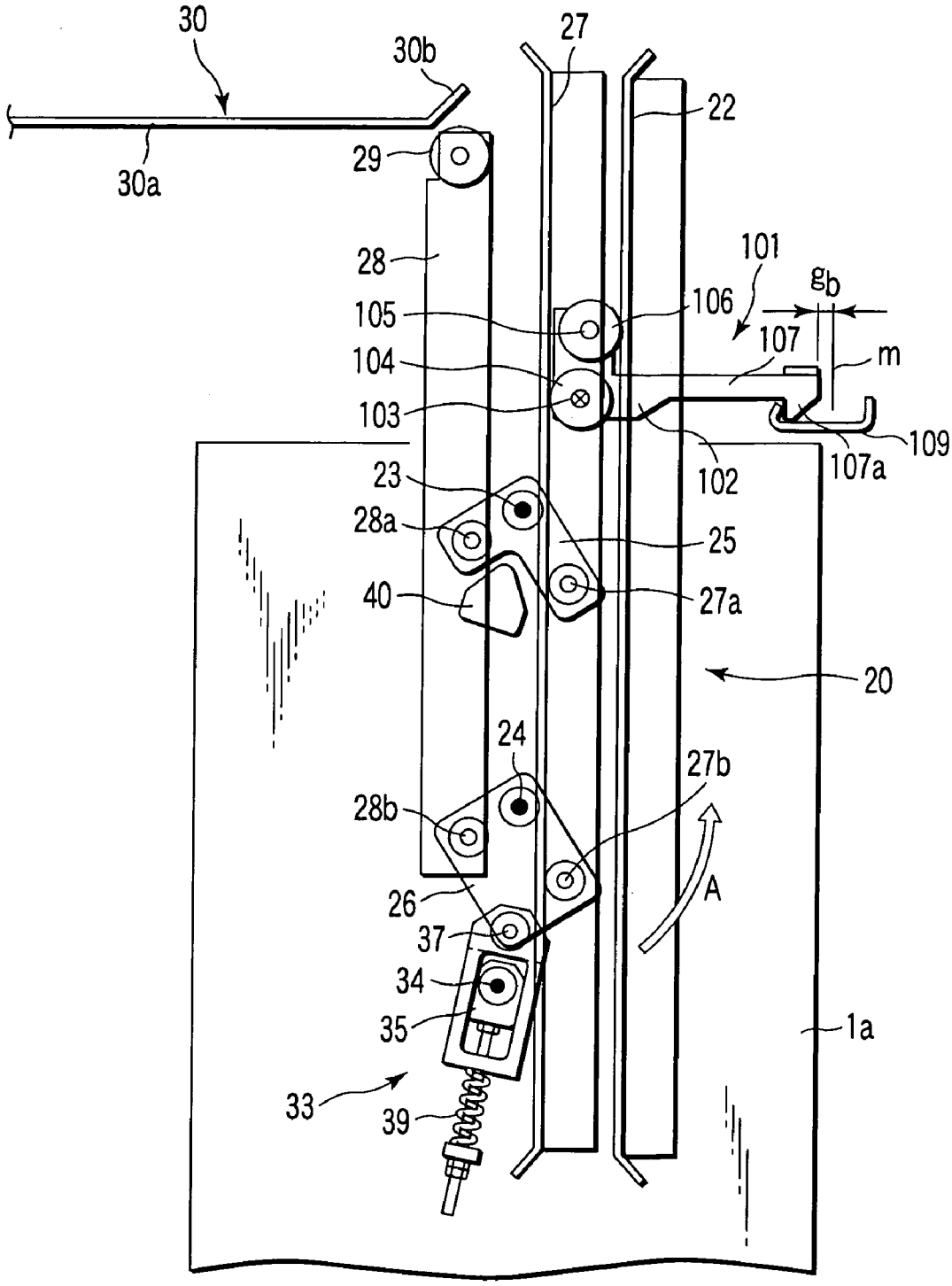
FIG. 6 is a diagram showing how the engaging device operates in a third stage in which the car door is further closed compared to the second stage shown in FIG. 5.
Figure 7:
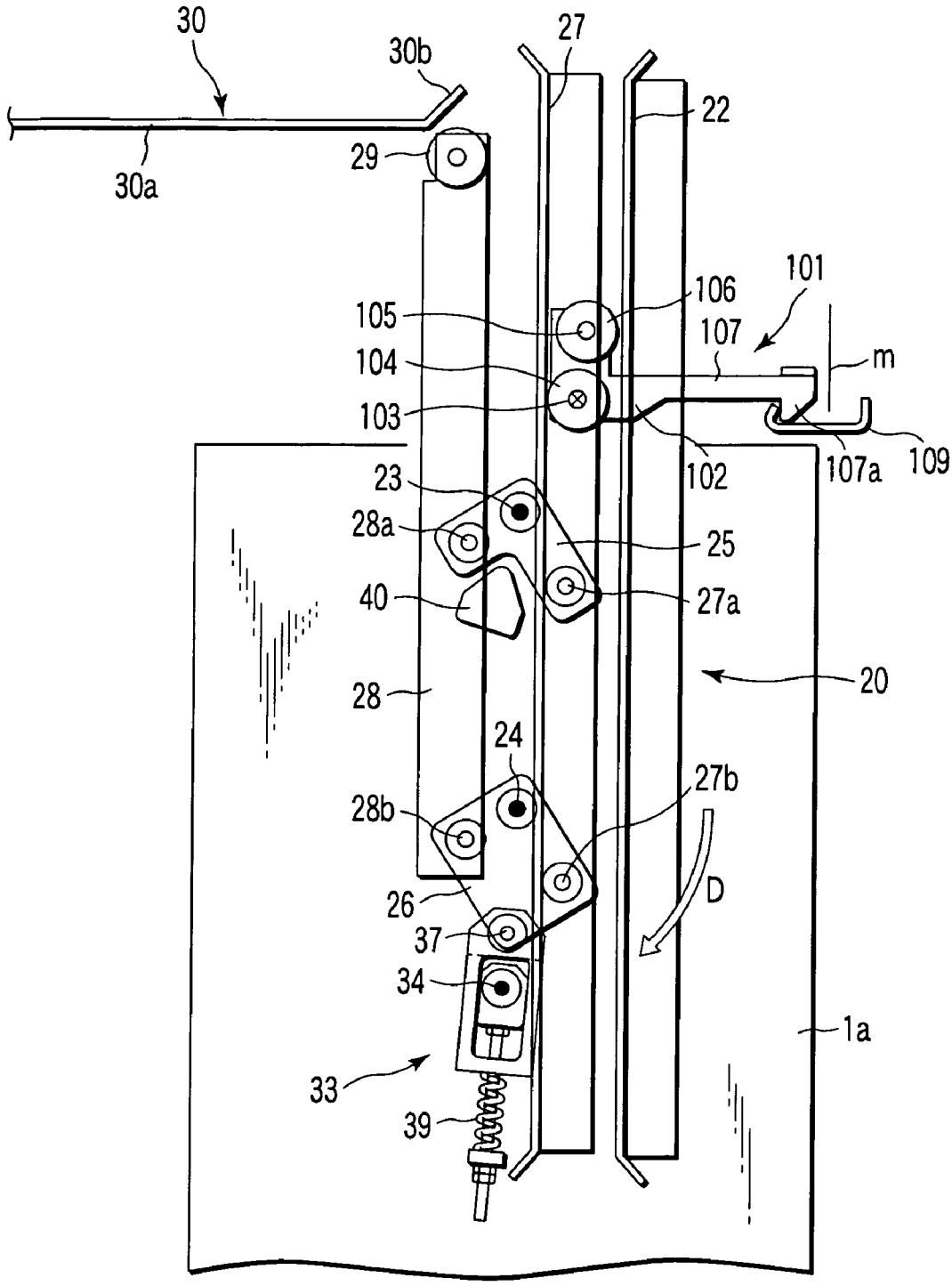
FIG. 7 is a diagram showing how the engaging device operates in a fourth stage in which the car door is further closed compared to the third stage shown in FIG. 6.

In the state shown in FIG. 6, the car door 1*a* is still at a short distance gb (for example, 7 mm) from the door stop position m. Further, the link plate 26 is elastically urged by the compression spring 39 in a direction shown by arrow A in FIG. 6. When the car door 1*a* continues to further move a short distance (for example, 2 mm) in the closing direction, the link plate 26 further moves rotationally clockwise. The car door 1*a* soon reaches a neutral position where the shafts 24, 37, and 34 are lined up straight as shown in FIG. 7. In this state, the compression spring 39 is compressed most heavily and exerts the strongest elastic force.

Figure 8:
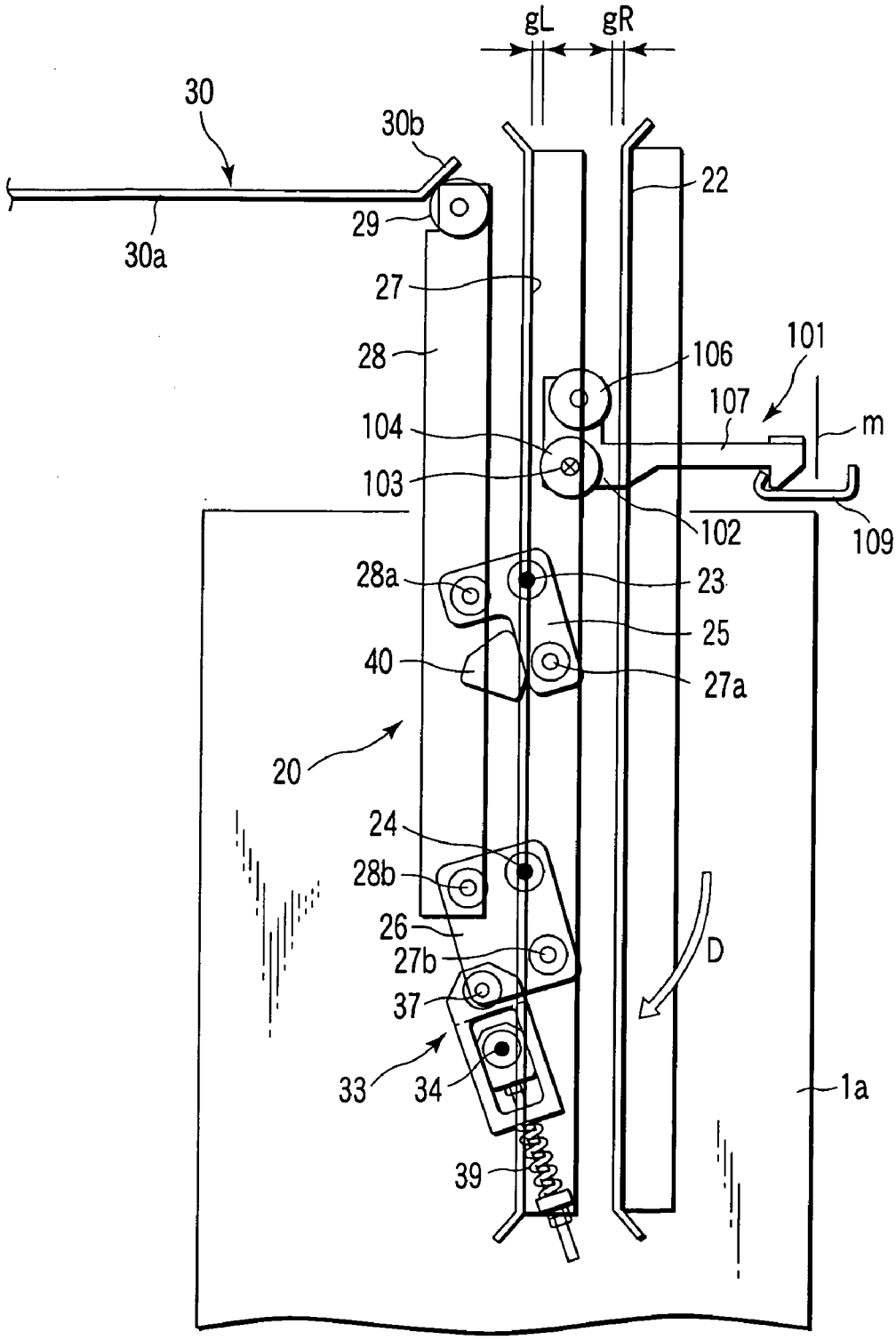
FIG. 8 is a diagram showing how the engaging device operates in a final stage in which the car door is further closed compared to the fourth stage shown in FIG. 7.

In the state shown in FIG. 7, when the car door 1*a* further moves in the closing direction, the link plate 26 further rotates clockwise in response to this movement. As a result, the shaft 37 is displaced leftward in FIG. 7 from the neutral position on a straight line joining the shafts 24 and 34 together. As a result of the displacement, the direction in which the elastic force of the compression spring 39 acts is reversed. The link plate 26 is elastically urged and moved rotationally, together with the link plate 25, in the opposite direction, that is, clockwise as shown by arrow D in FIG. 8. Since, a right arm portion of the link plate 25 abuts against the mechanical stopper 40 as shown in FIG. 8, the link plates 25 and 26 are stably stopped. Further, the car door 1*a* reaches the door stop position m. The car door 1 abuts against the car door 1*b* and is thus stopped. The state shown in FIG. 8 corresponds to a final stage in which the elevator door apparatus 10 is closed.

In the state shown in FIG. 8, the second engaging roller 106 is slightly biased toward the right end of the figure compared to the first engaging roller 104. Further, a gap gR (for example, 7 mm) is created between the second engaging roller 106 and the fixed vane 22. A gap gL (for example, 7 mm) is created between the first engaging roller 104 and the movable vane 27. When the elevator door apparatus 10 is completely closed, the gaps gR and gL are created. Thus the car door 1*a* is insulated from the hall doors 100*a* and 100*b*.

The link plate 26 is elastically urged, by the compression spring 39, clockwise around the shaft 24 as shown by arrow D in FIG. 8. The link plate 26 is thus stably stopped. Further, the cam roller 29 is placed where a very small gap is maintained between the cam roller 29 and the inclined portion 30*b* of the cam plate 30.

Figure 9:
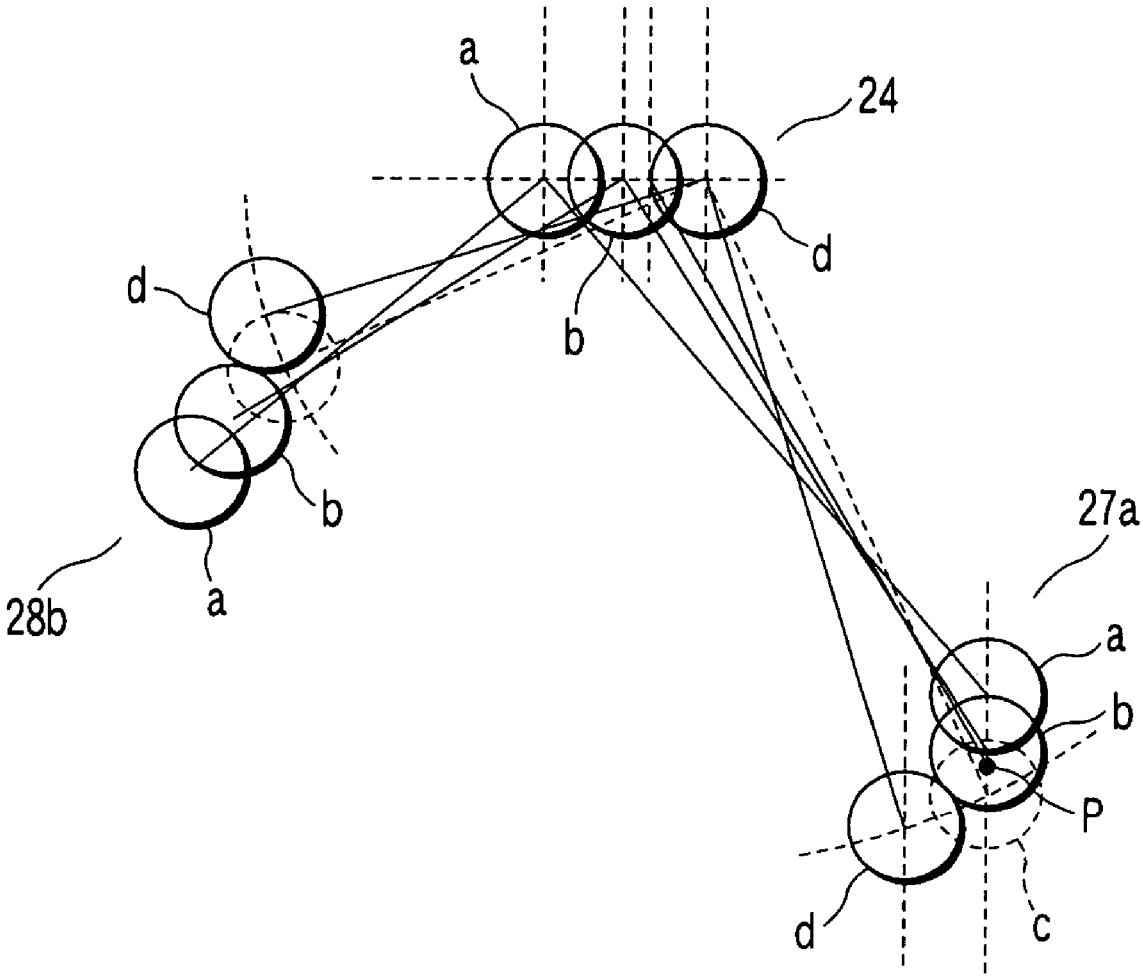
FIG. 9 is a diagram schematically showing the positional relationship among shafts provided on the car door and a link mechanism shown FIG. 1.
Figure 10:
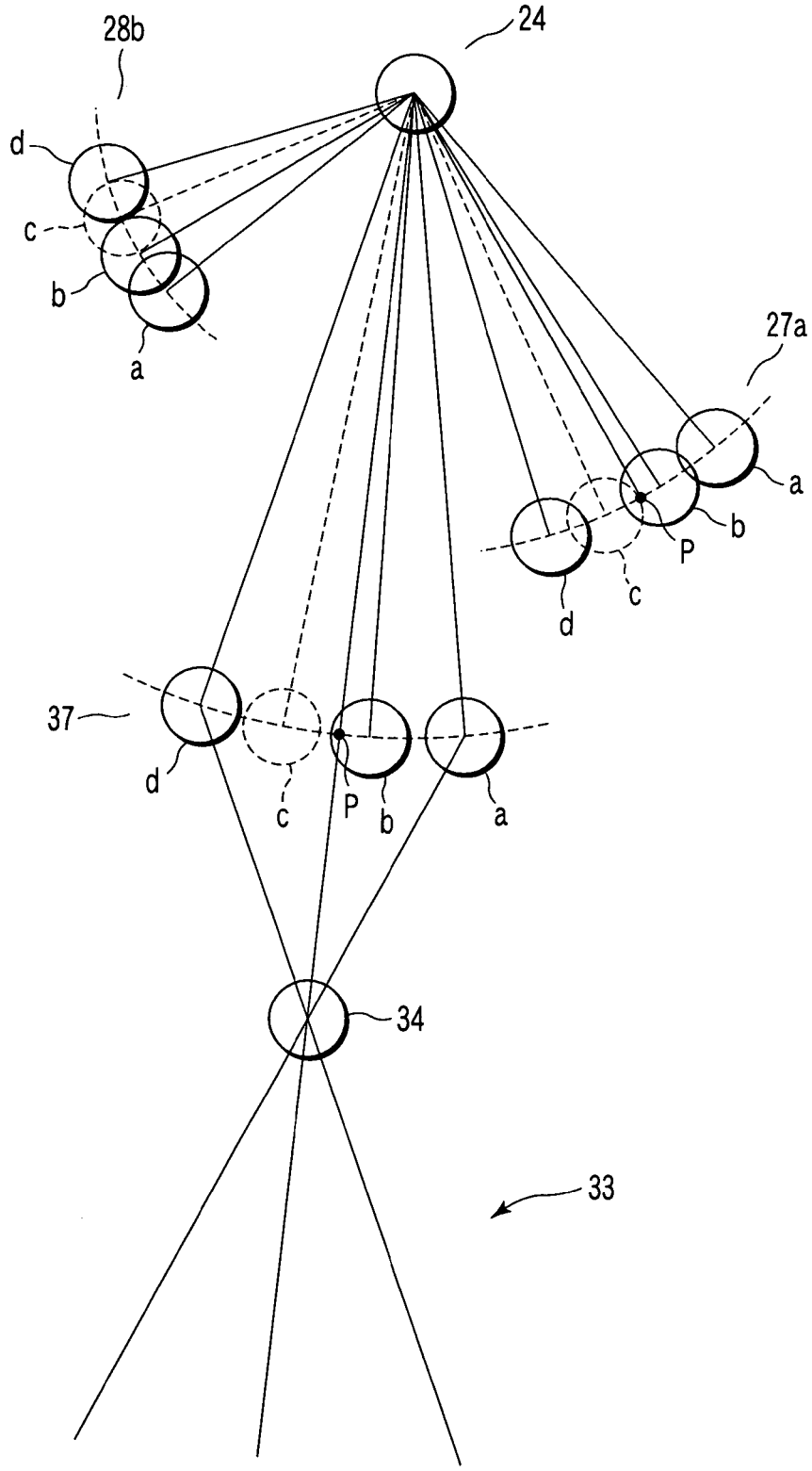
FIG. 10 is a diagram schematically showing the positional relationship among the shafts provided in the spring mechanism and link mechanism of the car door shown FIG. 1.

Then, with reference to FIGS. 9 to 11, description will be given of the relationship between the position of the car door 1*a* and the operating angle of the link plate 26 as well as the operation of the cam plate 30. FIG. 9 schematically shows the positional relationship among shafts 24, 27*b*, and 28*b* that move with the link plate 26 as the car door 1*a* is closed. FIG. 10 schematically shows straight lines joining the shaft 24, which constitutes a coordinate point fixed to the car door 1*a*, and the other shafts 27*b*, 28*b*, and 37 together, as well as a centerline of the spring guide bar 38. In FIGS. 9 and 10, the postures at the points denoted by "a", "b", "c", and "d" correspond to the positions shown in FIGS. 5, 6, 7, and 8. In particular, "p" correspond to the state in FIG. 7 is shown by a small black circle.

In the position "a" shown in FIGS. 9 and 10, the hall doors 100*a* and 100*b* are completely closed, and the first engaging roller 104 is immobilized. Consequently, in the state shown in FIG. 6 and corresponding to the next stage, the shaft 27*a* is pushed down from the position "a" and moved to the position "b". Moreover, after the car door 1*a* passes through the position (shown at "p") where the shafts 24, 37, and 34 are lined up straight in the state shown in FIG. 7, the car door 1*a* reaches the posture at the position "d" corresponding to the state shown in FIG. 8, under the elastic force of the compression spring 39 and without stopping in the posture at the position "c", shown by a broken line.

In the position "c", the movable vane 27 remains in contact with the engaging roller 104 even after the car door 1*a* has been completely closed. However, as described above, the movable vane 27 is not continuously held in this position.

In this manner, until the hall doors 100*a* and 100*b* reach the door stop position m, the engaging device 20 can maintain reliable engagement between the car door 1*a* and the hall door 100*a*. Therefore the driving force of the car door 1*a* is transmitted to the hall door 100*a*. Further, the hall doors 100*a* and 100*b* can be appropriately completely closed without any automatic closing force exerted by the door closer. Moreover, the activation of the lock mechanism 101 and the disengagement of the car door 1*a* from the hall door 100*a* are carried out before the car door 1*a* reaches the door stop position m.

Operations of the cam roller 29 will be described with reference to FIG. 11. FIG. 11 shows the positions of the shafts 24 and 27*a* of the cam roller 29 and link plate 26; in the figure, these components overlap. As in the case of the preceding figure, the postures at the positions denoted by "a", "b", and "d" correspond to the states shown in FIGS. 5, 6, and 8, respectively. Further, the position denoted by "c" in FIG. 11 corresponds to the state "c" shown in FIGS. 9 and 10.

The link plates 25, 26 constitute a parallelogrammic link mechanism together with the cam support bar 28. Accordingly, the cam roller 29 moves along the same track as that of the shafts 28*a* and 28*b*. FIG. 11 also shows the motion of the cam roller 29 associated with the motion of the shaft 27*a*, which moves with the movable vane 27. As shown in FIG. 11, the series of operations for closing the elevator door apparatus 10 are completed, with the cam roller 29 remaining out of contact with the inclined portion 30*b* of the cam plate 30.

Figure 11:
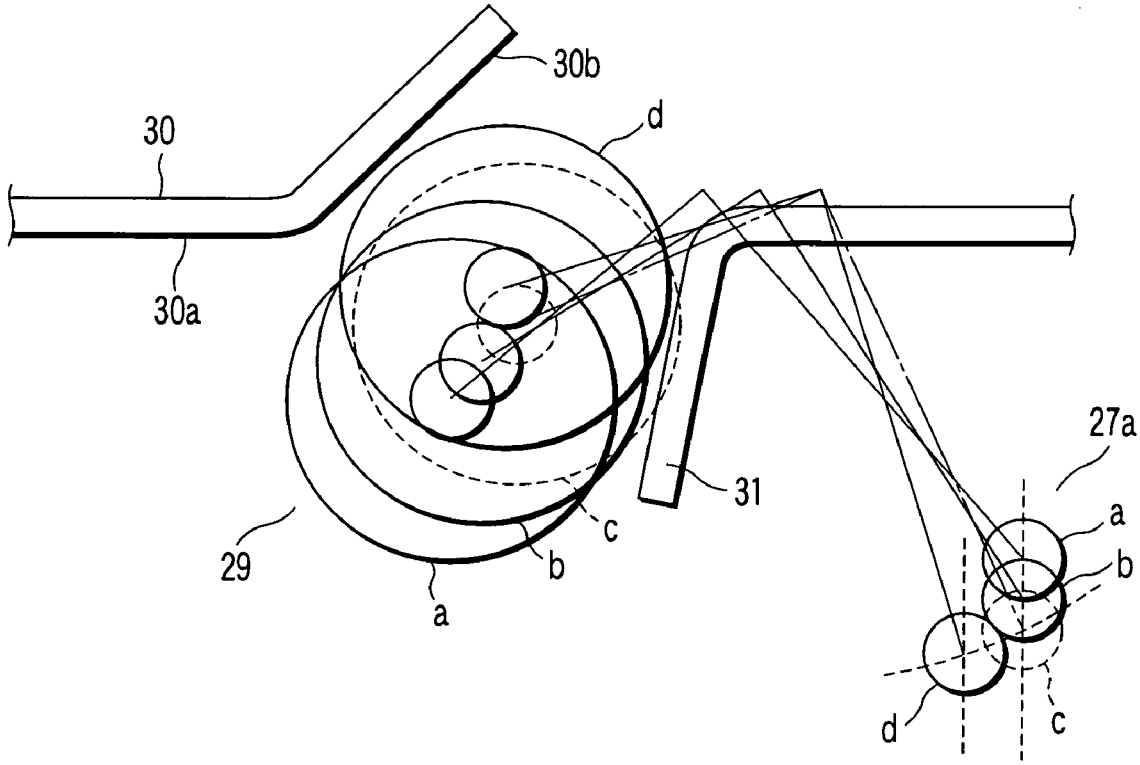
FIG. 11 is a diagram showing an operation of a cam mechanism of the engaging device shown in FIG. 1.

Further, the cam stop portion 31 is in the position shown in FIG. 11, so that the cam roller 29 does not reach the position "c", described above. Moreover, the cam stop portion 31 prevents the movable vane 27 from remaining in a position where it is too close to the fixed vane 22 even after the car door 1*a* has been moved without being engaged with the hall door 100*a* for regulations or the like. In particular, once the car door 1*a* has been completely closed, a specified distance between the movable vane 27 and the fixed vane 22 is maintained desired width.

Further, as shown in FIG. 4, if the car door 1*a* is far from the door stop position, the cam roller 29 is under the horizontal portion 30*a* of the cam plate 30. Thus, even if the hall door 100*a* or the car door 1*a* collides against an obstacle while the elevator door apparatus 10 is moving in the closing direction, the link plates 25 and 26 are prevented from rotating. Thus, a normal overload avoiding operation is performed smoothly.

Now, description will be given of operations performed when the elevator door apparatus 10 is opened. FIG. 8 shows a state in which the car has reached an elevator hall floor. In this state, when the car door 1*a* moves in a direction in which it is driven to open, that is, leftward in FIG. 8, the fixed vane 22 abuts against the second engaging roller 106. The second engaging roller 106 is moved rotationally counterclockwise around the shaft 103. Hence, the hook lever 102 is released from the engaging portion 109 to unlock the hall doors 100*a* and 100*b*.

Moreover, when the car door 1*a* moves leftward in the opening direction, the cam roller 29 abuts against the inclined portion 30*b* of the cam plate 30. The cam roller 29 is then received to a downward force. As the car door 1*a* moves in this state, the cam roller 29 moves along the inclined portion 30*b* of the cam plate 30. As a result, the cam roller 29 is pushed downward to rotate the link plates 25 and 26 counterclockwise against the force of the compression spring 39. Then, the state shifts to the neutral point in which the shafts 24, 37, and 34 are lined up straight as sown in FIG. 6 and then transfers to the one shown in FIG. 4. Subsequently, when the car doors 1*a* and 1*b* move in their opening directions, the hall door 10*a*, engaged with the car door 1*a*, also moves. Thus, the hall door 100*a*, together with the hall door 100*b*, is completely opened.

With this configuration, the elastic force of the compression spring 39 holds the movable vane 27 in a position in which it engages appropriately with the engaging rollers 104 and 106. If the elevator door apparatus 10 is to be closed, the engagement is stably maintained by the elastic force of the spring 39 until the hall doors 100*a* and 100*b* are completely closed. In other words, the driving force of the car door 1*a* is appropriately exerted on the hall door 100*a*. This eliminates the need to enhance the force of the door closer which acts in the direction in which the hall doors 100*a* and 100*b* are automatically closed. Further, even if a strong wind pressure is exerted on the hall doors 100*a* and 100*b*, a force sufficient to close the doors is maintained. Consequently, the hall doors 100*a* and 100*b* can be properly completely closed.

After the hall doors 100*a* and 100*b* have been completely closed and stopped, when the car door 1*a* moves in the closing direction, the direction in which the elastic force of the compression spring 39 acts is switched. As a result, the movable vane 27 is appropriately urged in a direction in which it leaves from the first engaging roller 104 and second engaging roller 106. Further, the movable vane 27 and the fixed vane 22 are properly disengaged from the first engaging roller 104 and the second engaging roller 106. The disengaged state is stably maintained by the elastic force of the spring 39. The cam roller 29 is not used in disengaging the movable vane 27 and the fixed vane 22 from the first engaging roller 104 and the second engaging roller 106. This facilitates the adjustment of the positions of the hall doors 100*a* and 100*b* and cam roller 29.

Since, the cam roller 29 is abutting against the cam stop portion 31 while the car door 1*a* is closed, the movable vane 27 is inhibited from moving toward the fixed vane 22. This prevents the movable vane 27 from moving toward the fixed vane 22 to reduce the distance between the movable vane 27 and the fixed vane 22 below the predetermined value even when the car door 1*a* is operated without being engaged with the hall door 100*a* in order to, for example, regulate the elevator door apparatus 10. Consequently, when the car is moved after regulations, the movable vane 27 is prevented from colliding against the first engaging roller 104 or the second engaging roller 106. This ensures safety.

Even if a door collides against an obstacle while the elevator door apparatus 10 is moving in the closing direction, the movable vane 27 is prevented from moving. Consequently, the overload avoiding operation can be smoothly performed even during closure without any vibration or unstable operation.

Immediately after the elevator door apparatus 10 starts to be opened, the cam roller 29 has been shoved under the cam plate 30 against the elastic force of the compression spring 39. At this time, if the driving force applied to the car door 1*a* is lost owing to power failure or the like, it is possible to prevent the car door 1*a* from being unpredictably opened by the elastic force of the compression spring 39. This also ensures safety.

Further, the car door 1*a* and 1*b* can be attached directly to the driving belt 5 (of the car door). It is thus possible to appropriately match the position of the driving belt 5 with the positions of the car doors 1*a* and 1*b*. This eliminates the need for an exclusive connecting mechanism for synchronizing the positions of the two car doors 1*a* and 1*b*. As a result, the mechanism of the apparatus can be simplified.

Moreover, the compression spring 39 of the spring unit 33 is exposed to the exterior. This makes it possible to facilitate the adjustment of the elastic force of the spring 39 and the replacement of the spring 39. Further, the space required to mount the engaging device 20 is almost the same as that for the conventional engaging device. Consequently, the engaging device can be easily mounted in already installed elevators.

In the other embodiments described below, components having the same functions as those in the first embodiment will respectively applying the same reference numerals and symbols, with their description omitted. In addition, for the hall doors 100*a* and 100*b* and the lock mechanism 101, the description of the first embodiment and FIG. 3 will be referred to.

Second Embodiment

Figure 12:
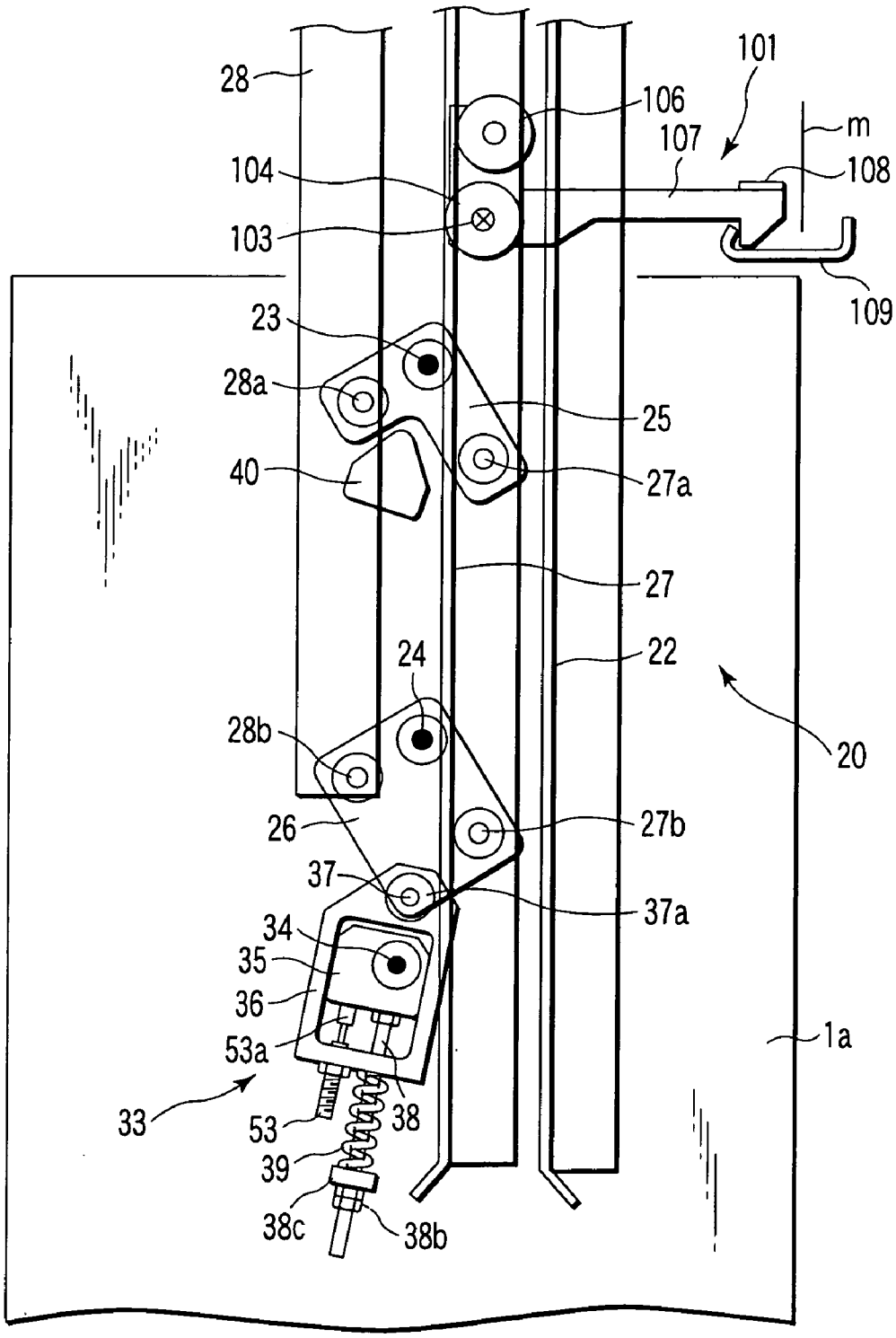
FIG. 12 is a diagram showing how the engaging device operates in a stage in which an elevator door apparatus of a second embodiment according to the present invention is being closed.
Figure 13:
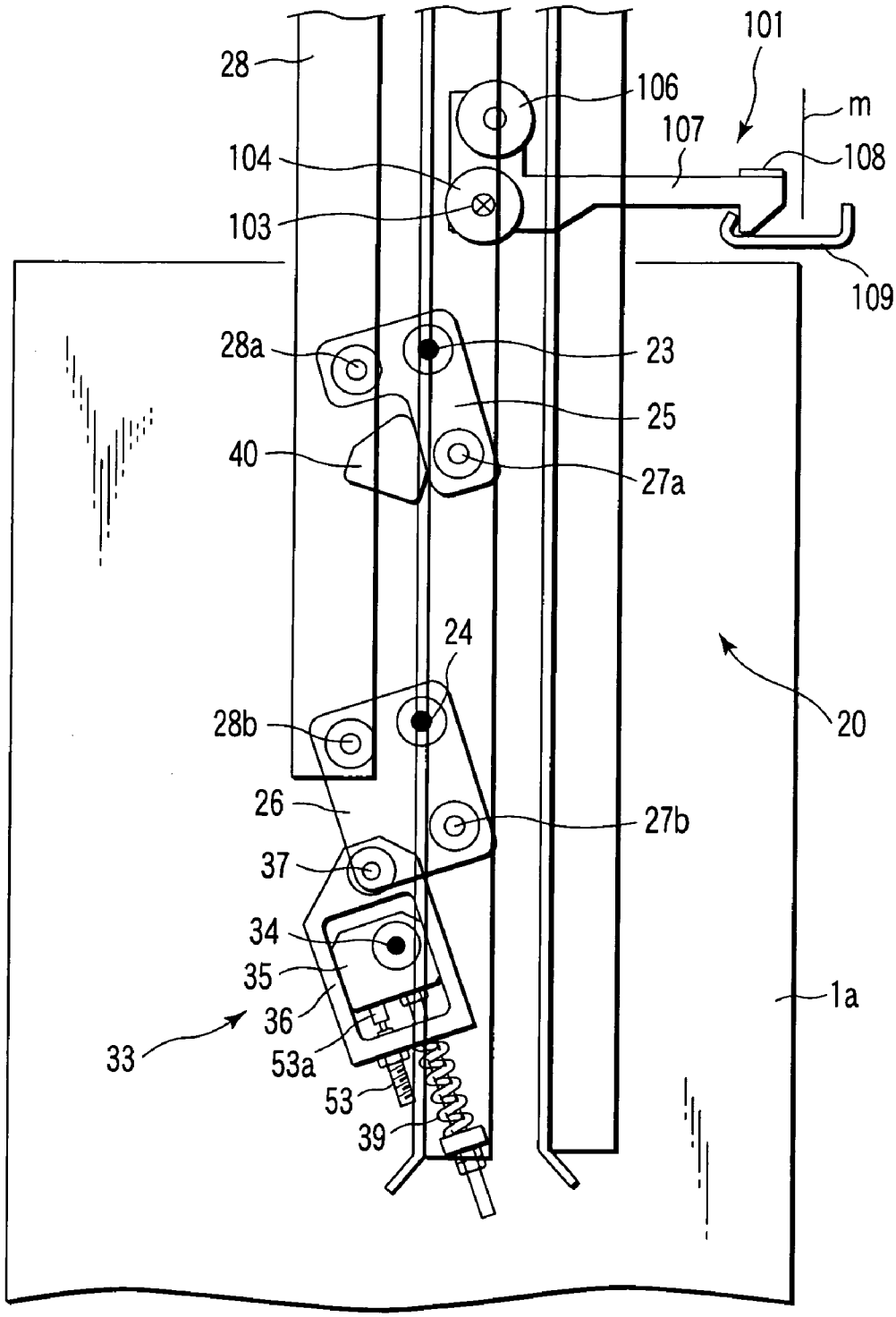
FIG. 13 is a diagram showing how the engaging device shown in FIG. 12 operates in a final stage.

An elevator door apparatus 10 of a second embodiment according to the present invention will be described with reference to FIGS. 12 and 13. In the elevator door apparatus 10 according to the present embodiment, the configuration of the spring unit 33 is partly different from that in the first embodiment. In FIGS. 12 and 13, the spring unit 33 comprises the block 35, the block frame 36, the spring guide bar 38, the compression spring 39, and a shock absorber 53.

The base plate 21 is fixed to the car door 1*a*. The shaft 34 is fixed to the base plate 21. The block 35 is rotatably assembled to the shaft 34 via the bearing 34*a*. The block frame 36 surrounds the block 35 and can slide with respect to the block 35. The top of the block frame 36 is rotatably attached to the shaft 37 via the bearing 37*a*. The shaft 37 is fixed to the bottom of the link plate 26.

The spring guide bar 38 is attached to the bottom of the block 35 and slidably extends downward through the block frame 36. The compression spring 39 is installed around the spring guide bar 38, which projects downward from the block frame 36. The external thread 38*a* is machined on the lower end of the spring guide bar 38. The compression spring 39 is assembled to the spring unit 33, so as to be compressed by the spring presser plate 38*c* and nut 38*b* inserted around the external thread 38*a*. The elastic force of the compression spring 39 urges the shaft 37, fixed to the link plate 26, away from the shaft 34, fixed to the base plate 21.

The shock absorber 53 is an example of attenuation applying means. The shock absorber 53 is screwed through a lower wall of the block frame 36. A telescopic head 53*a* of the shock absorber 53 is fixed to a lower end of the block 35.

FIG. 12 shows that after the hall door has been closed, the car door 1*a* moves in the closing direction to activate the lock mechanism 101. In this state, when the car door 1*a* further moves in the closing direction and the lock mechanism 101 is activated, the spring unit 33 rotates counterclockwise around the shaft 34. When the spring unit 33 passes beyond the neutral position where the shafts 24, 37, and 34 are lined up straight. The spring 39 expands, and telescopic head 53*a* of the shock absorber 53 is pushed in. FIG. 13 shows that the car door 1*a* has been completely closed.

When the car door 1*a* moves in the opening direction, the spring unit 33 rotates counterclockwise. Even if the spring unit 33 moves rotationally so that the first engaging roller 104 and the second engaging roller 106 are sandwiched between the fixed vane 22 and the movable vane 27, the telescopic head 53*a* of the shock absorber 53 is similarly pushed in.

In this manner, when the spring 39 expands, the telescopic head 53*a* is pushed in, so that its kinetic energy is absorbed. This makes it possible to reduce the moving speed of the movable vane 27, thus the operating sound or vibration is prevented to occur. In the present embodiment, the shock absorber 53 is attached directly to the spring unit 33. The shock absorber 53 may be attached to the movable vane 27 or link plate 25 or 26 to attenuate its motion. Further, it is possible to use attenuation applying means such as an oil damper, a gas damper, vibration isolating rubber, or a dash pot in place of the shock absorber 53.

Third Embodiment

Figure 14:
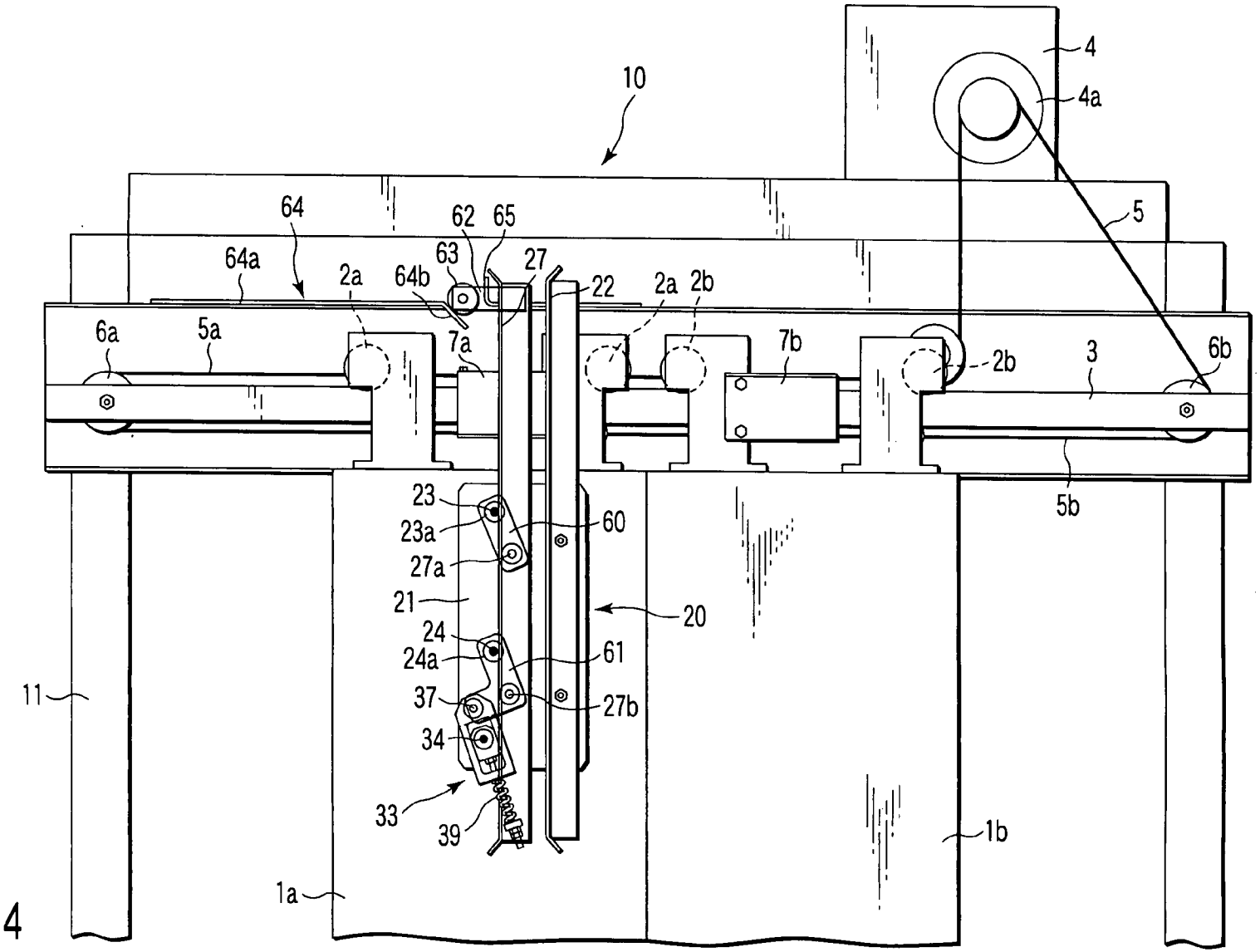
FIG. 14 is a front view of a car door of an elevator door apparatus of a third embodiment according to the present invention as viewed from a hall.

Now, with reference to FIGS. 14 to 16, description will be given of the elevator door apparatus 10 according to a third embodiment. In FIG. 14, the engaging device 20 comprises the base plate 21, the fixed vane 22, link plates 60 and 61, the movable vane 27, a mounting plate 62, a cam mechanism, and the spring unit 33. The base plate 21 is fixed to the car door 1*a*. The shafts 23 and 24 are fixed to the base plate 21. The link plates 60 and 61 are rotatably assembled to the shafts 23 and 24 via the bearings 23*a* and 24*a*, respectively.

The movable vane 27 has the shafts 27*a* and 27*b*. The link plate 60 is connected to the shaft 27*a*. The link plate 61 is connected to the shaft 27*b*. The link plates 60 and 61 and the movable vane 27 constitute a sub-parallelogrammic link mechanism. The spring unit 33 is attached to the bottom of the link plate 61 via the shaft 37 as in the case of the first embodiment.

The mounting plate 62 is fixed to the top of the movable vane 27. A cam roller 63 of the cam mechanism is supported by the mounting plate 62 via a shaft. A cam plate 64 of the cam mechanism is fixed to the frame member 11 of the car door apparatus. The cam roller 63 can abut against the inclined portion 64*b* of the cam plate 64. Further, a cam stop portion 65 is provided away from the cam plate 64 and closer to the door stop side.

The operation of the third embodiment will be described below with reference to FIGS. 15 and 16. In the embodiment, the operations of the movable vane 27 and engaging rollers 104 and 106 are the same as those in the first and second embodiments.

Figure 15:
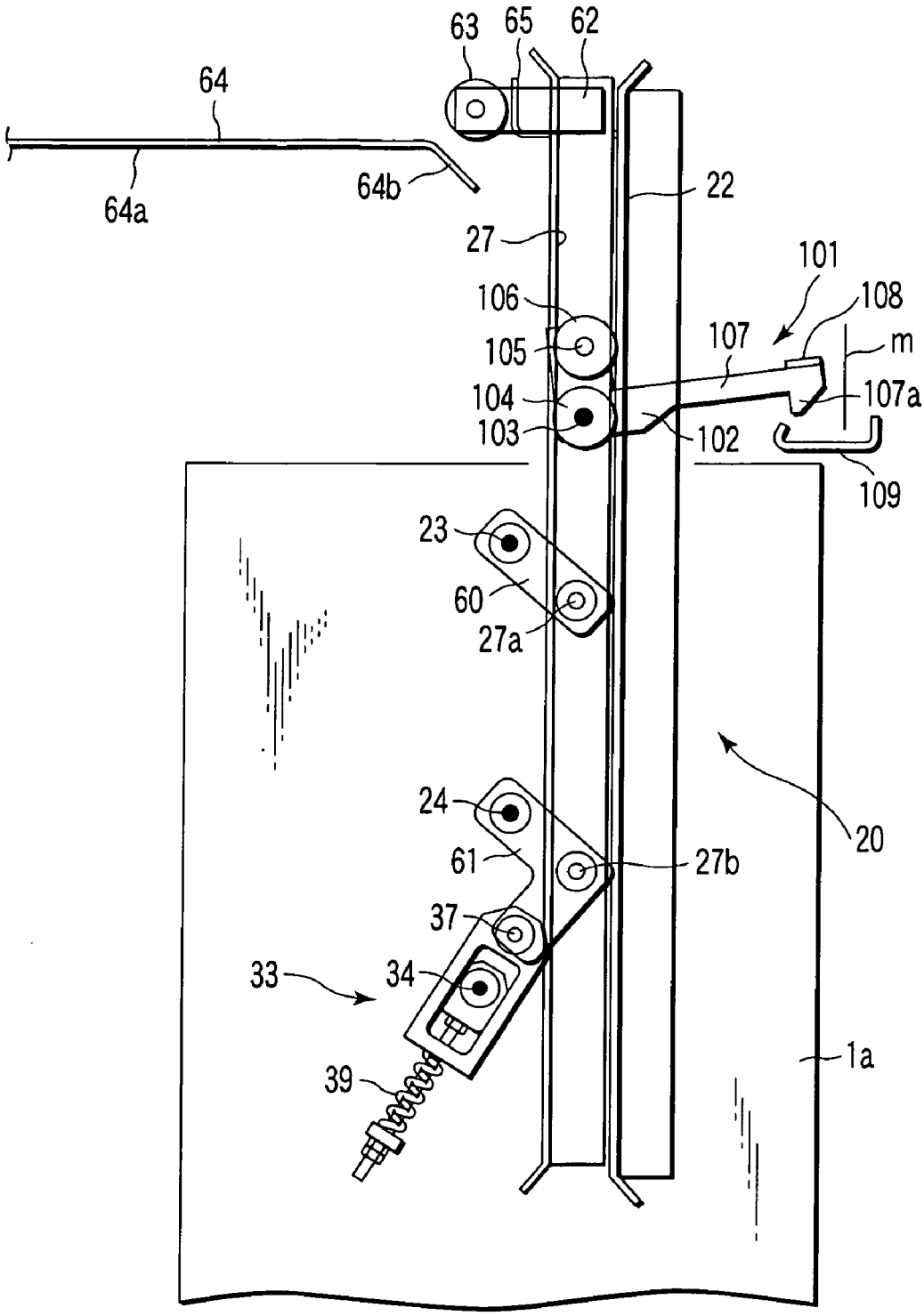
FIG. 15 is a diagram showing how the engaging device operates in a stage in which the door apparatus shown in FIG. 14 is being closed.
Figure 16:
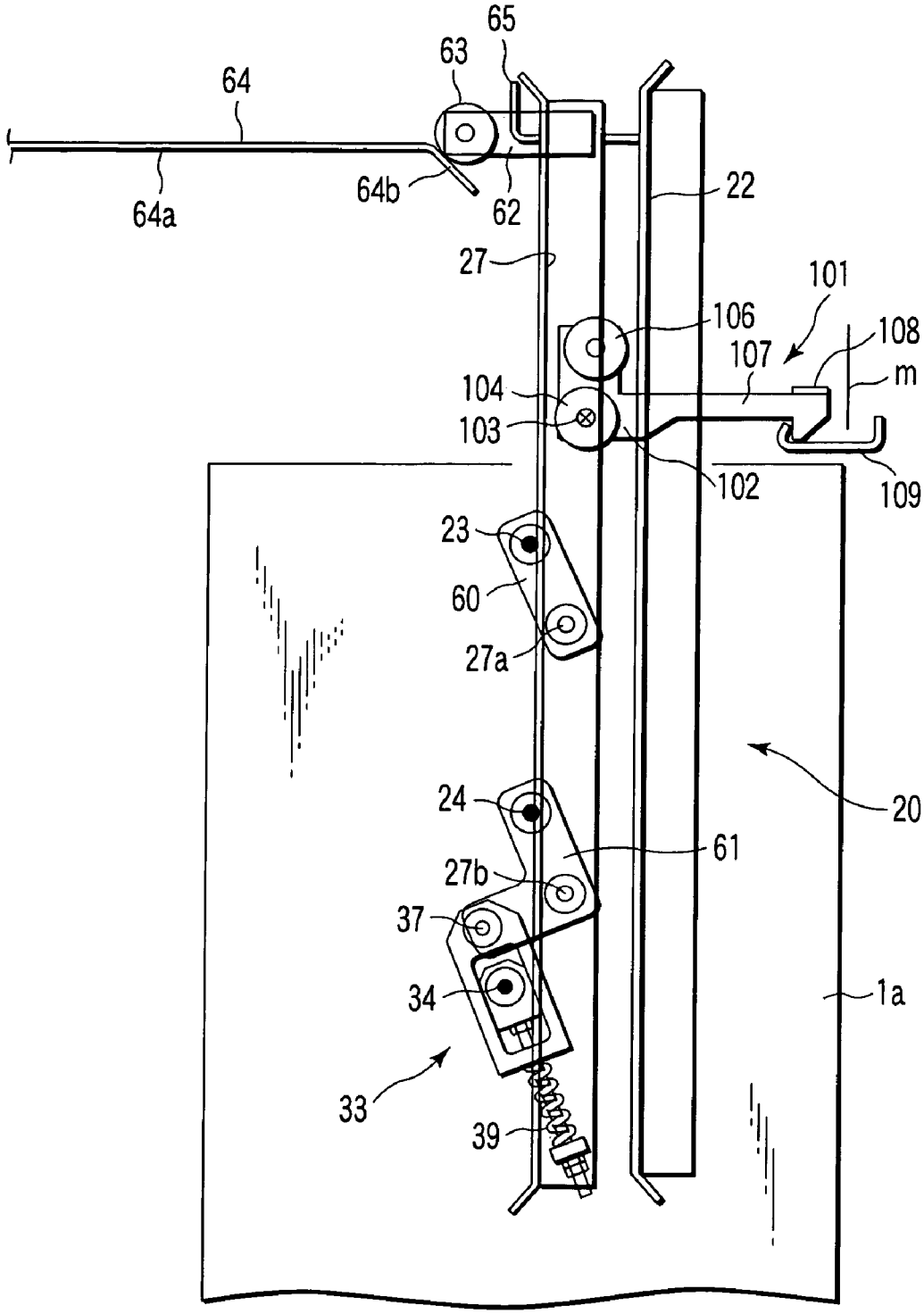
FIG. 16 is a diagram showing how the engaging device shown in FIG. 15 operates in a final stage.

FIG. 15 shows that the hall door has been completely closed and that the spring unit 33 starts to rotate counterclockwise around the shaft 34. When the car door 1*a* shifts in the closing direction from the state shown in FIG. 15, the hook lever 102 engages with the engaging portion 109 and the spring unit 33 rotationally moves counterclockwise in FIG. 15. Since the distance between the fixed vane 22 and the movable vane 27 widens, the fixed vane 22 and the movable vane 27 disengage from the first engaging roller 104 and second engaging roller 106 of the hall door. Then, the engaging device 20 reaches the state shown in FIG. 16. In the above process, the cam roller 63 remains out of contact with the inclined portion 64*b* of the cam plate 64.

If the elevator door apparatus is to be opened, the hall door is unlocked because the fixed vane 22 abuts against the engaging roller 106 as in the case of the first and second embodiments. The cam roller 63 climes up onto the horizontal portion 64*a* of the cam plate 64 through the inclined portion 64*b*. The movable vane 27 is then lifted up. As a result, the spring unit 33 moves rotationally counterclockwise around the shaft 34. The urging force of the spring 39 urges the movable vane 27 toward the fixed vane 22. The engaging rollers 104 and 106 are sandwiched between the movable vane 27 and the fixed vane 22. The hall door is driven in the opening direction together with the car door 1*a*.

Further, the movable vane 27 is prevented from moving toward the fixed vane 22 while the car door 1*a* is closed by causing the cam stop portion 65 is provided in the elevator door apparatus 10.

The present embodiment eliminates the need for an exclusive cam support bar used to support the cam roller 63. This makes it possible to reduce the number of parts required. In the present embodiment, the attenuation applying means shown in the second embodiment may also be provided in the spring unit 33.

Fourth Embodiment

Figure 17:
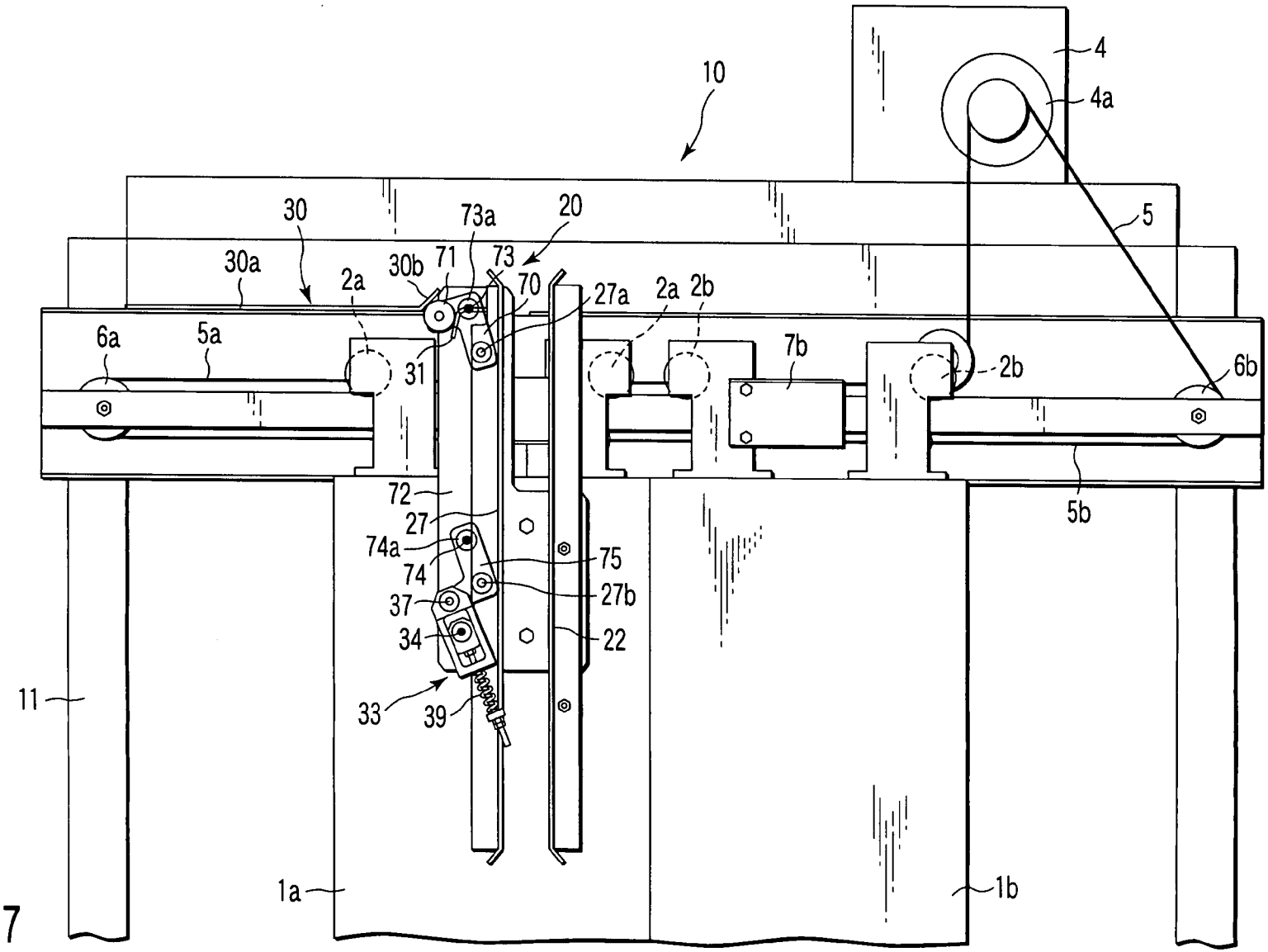
FIG. 17 is a front view of the car door of an elevator door apparatus of a fourth embodiment according to the present invention as viewed from a hall.
Figure 18:
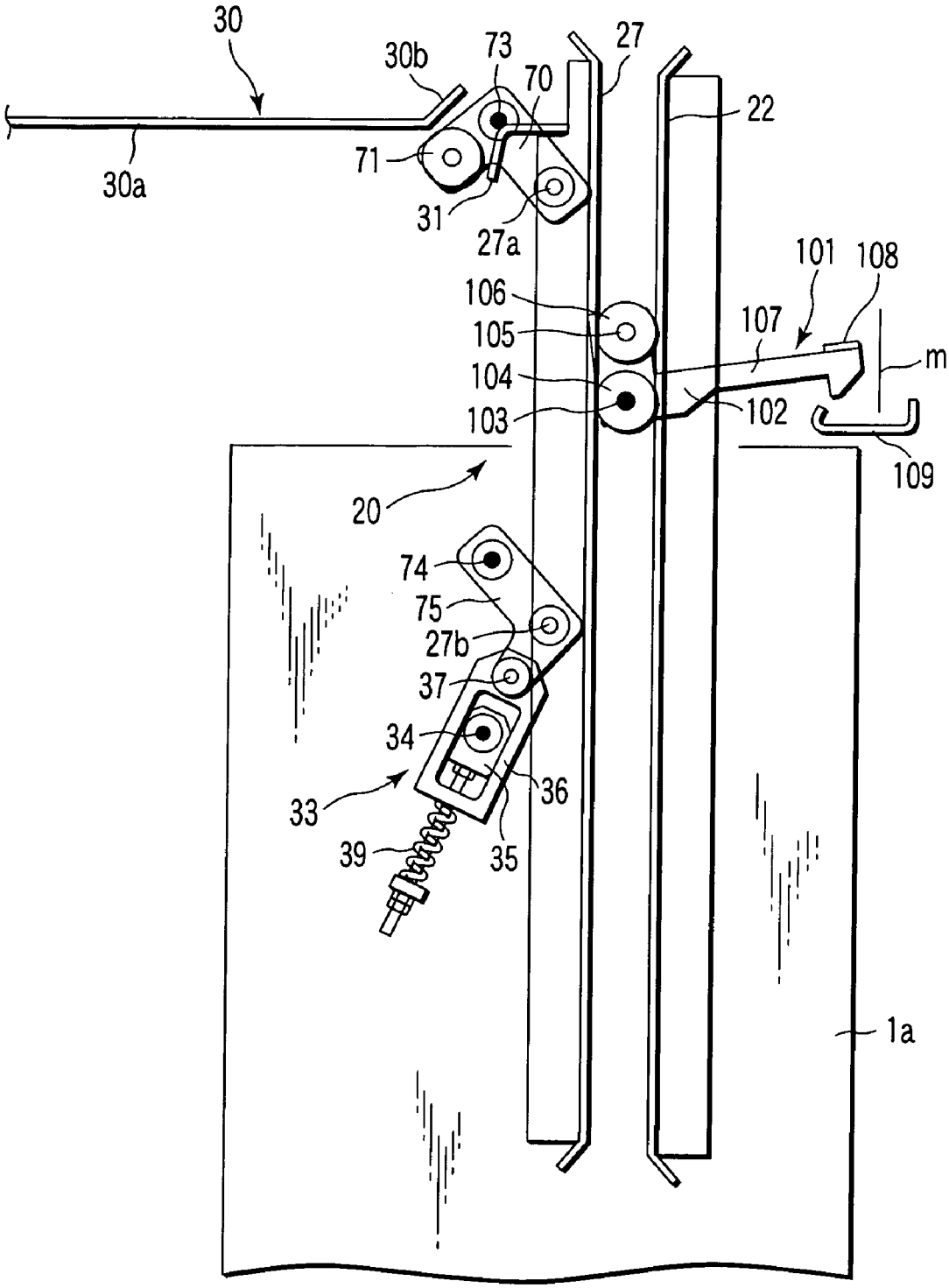
FIG. 18 is a diagram showing how the engaging device operates in a stage in which the elevator door apparatus shown in FIG. 17 is being closed.
Figure 19:
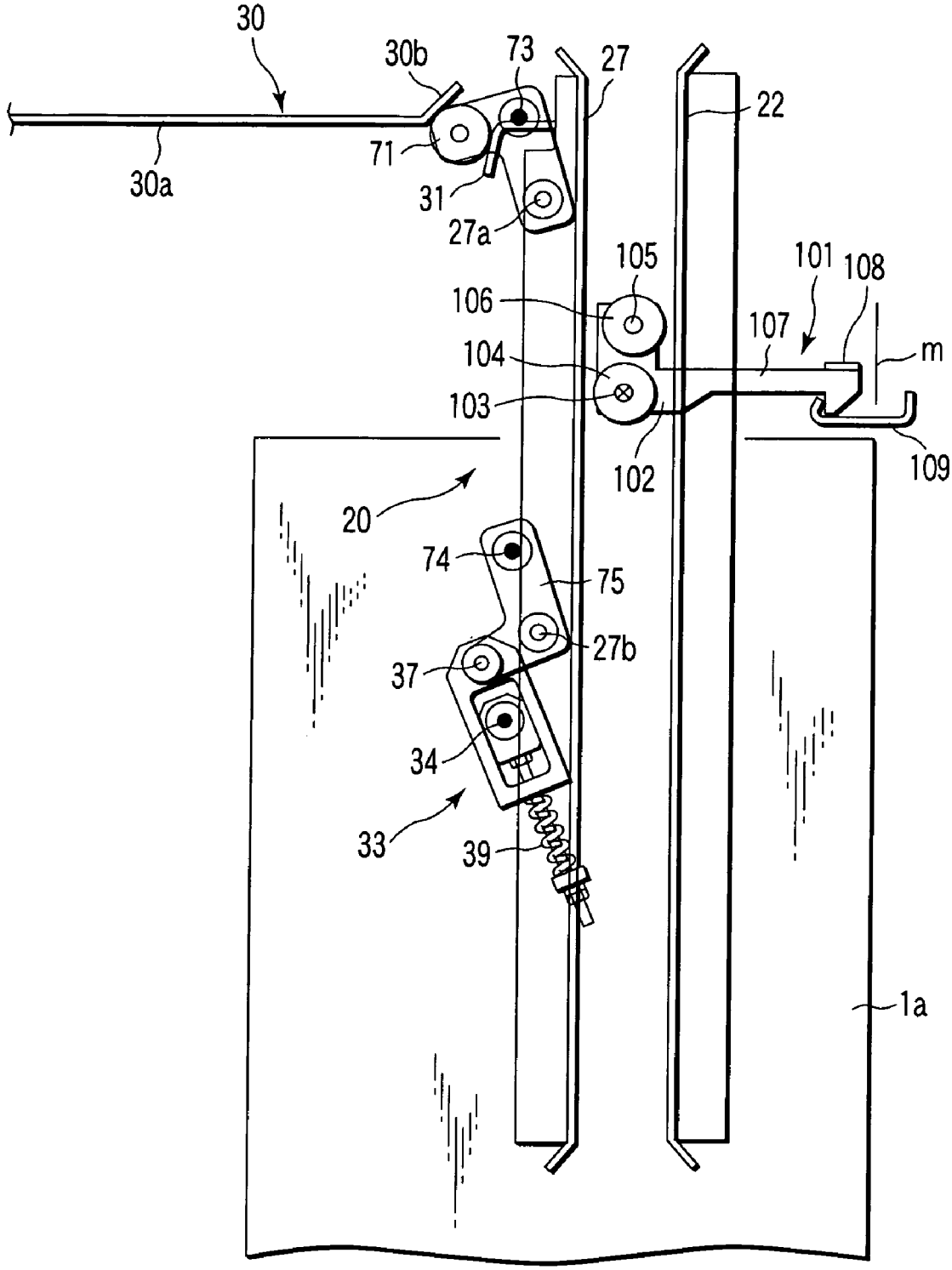
FIG. 19 is a diagram showing how the engaging device shown in FIG. 18 operates in a final stage.

With reference to FIGS. 17 to 19, description will be given of the elevator door apparatus 10 according to a fourth embodiment. For the hall doors 100*a* and 100*b* and the lock mechanism 101, the description of the first embodiment and FIG. 3 will be referred to. The present embodiment differs from the above embodiments in that a cam roller 71 is attached directly to an end of a link plate 70 of a link mechanism provided closer to the top of the apparatus. The other parts are configured in almost the same manner as in the elevator door apparatus 10, described in the first to third embodiments.

The engaging device 20 of the elevator door apparatus 10 comprises the base plate 72, the fixed vane 22, the movable vane 27, link plates 70 and 75, the spring unit 33, and a cam mechanism. The cam mechanism is composed of the cam plate 30 and the cam roller 71. As shown in FIG. 17, the base plate 72, fixed to the car door 1*a*, partly extends upward to the vicinity of the cam plate 30. The base plate 72 has shafts 73 and 74. The link plate 70 is rotationally movably connected to the shaft 73 via the bearing 73*a*. The link plate 75 is rotationally movably connected to the shaft 74 via the bearing 74*a*. The movable vane 27 is rotationally movably connected to the link plates 70 and 75 via the shafts 27*a* and 27*b*. The link plates 70 and 75 and the movable vane 27 constitute a sub-parallelogrammic link mechanism.

In the present embodiment, the direction of the L-shaped cross section of the movable vane 27 is different from that of the movable vane 27 according to the first to third embodiment. A plane parallel to the plane in which the car door moves extends opposite the fixed vane 22. The spring unit 33 is rotationally movably attached to the bottom of the link plate 75 via the shaft 37 as in the case of the first to third embodiments.

With reference to FIGS. 18 and 19, description will be given of the operation of the elevator door apparatus 10 configured as described above. The operations of the movable vane 27 and engaging rollers 104 and 106 are the same as those in the elevator door apparatus 10 described in the first to third embodiments.

FIG. 18 shows the engaging device 20 observed immediately after the hall door has been completely closed. In the state shown in FIG. 18, when the car door 1*a* moves in the closing direction, the lock mechanism 101 is activated, and the spring unit 33 rotationally moves counterclockwise around the shaft 34. As a result, as shown in FIG. 19, the distance between the fixed vane 22 and the movable vane 27 widens to disengage the hall doors 100*a* and 100*b* from the car door 1*a*.

When the elevator door apparatus 10 is to be opened, it operates similarly to the elevator door apparatus 10 described in the first to third embodiments. Since the first engaging roller 104 and the second engaging roller 106 are sandwiched between the fixed vane 22 and the movable vane 27, the lock mechanism 101 is released. Further, the spring unit 33 moves rotationally clockwise, therefore the hall door engage with the car door 1*a*. The operations of the cam plate 30 and cam stop portion 31 are the same as those in the first to third embodiments. The present embodiment eliminates the need for a bar that supports the cam roller 71. This reduces the number of parts required compared to the elevator door apparatus 10 according to the third embodiment.

Fifth Embodiment

An elevator door apparatus according to a fifth embodiment will be described with reference to FIGS. 20 and 21. The engaging device 20 of the elevator door apparatus comprises a base plate 80, the fixed vane 22, the movable vane 27, link plates 83 and 84, a helical torsion spring 87, the mounting plate 62, and a cam mechanism. The base plate 80 is fixed to the car door la. Shafts 81 and 82 are fixed to the base plate 80.

The link plates 83 and 84 are rotationally movably assembled to the shafts 81 and 82 via bearings 81*a* and 82*a*, respectively. The movable vane 27 comprises the shafts 27*a* and 27*b*. The link plate 83 is rotationally movably connected to the shaft 27*a*. The link plate 84 is rotationally movably connected to the shaft 27*b*.

The link plates 83 and 84 and the movable vane 27 constitute a parallelogrammic link mechanism.

The helical torsion spring 87 is a form of a spring mechanism. The helical torsion spring 87 is attached between a shaft 85 provided at the bottom of the link plate 83 and a shaft 86 provided on the base plate 80. The helical torsion spring 87 is elastically urged in a direction in which the shafts 85 and 86 move away from each other, that is, in a direction in which the link plate 83 moves rotationally counterclockwise around the shaft 81 in FIG. 20. Further, the helical torsion spring 87 is supported so as to be rotationally movable around the shafts 85 and 86.

The following components of the present embodiment are configured in the same manner as described in the third embodiment: the mounting plate 62, cam roller 63, cam plate 64, cam stop portion 65, engaging rollers 104 and 106, hook lever 102, engaging portion 109, and the like.

Figure 20:
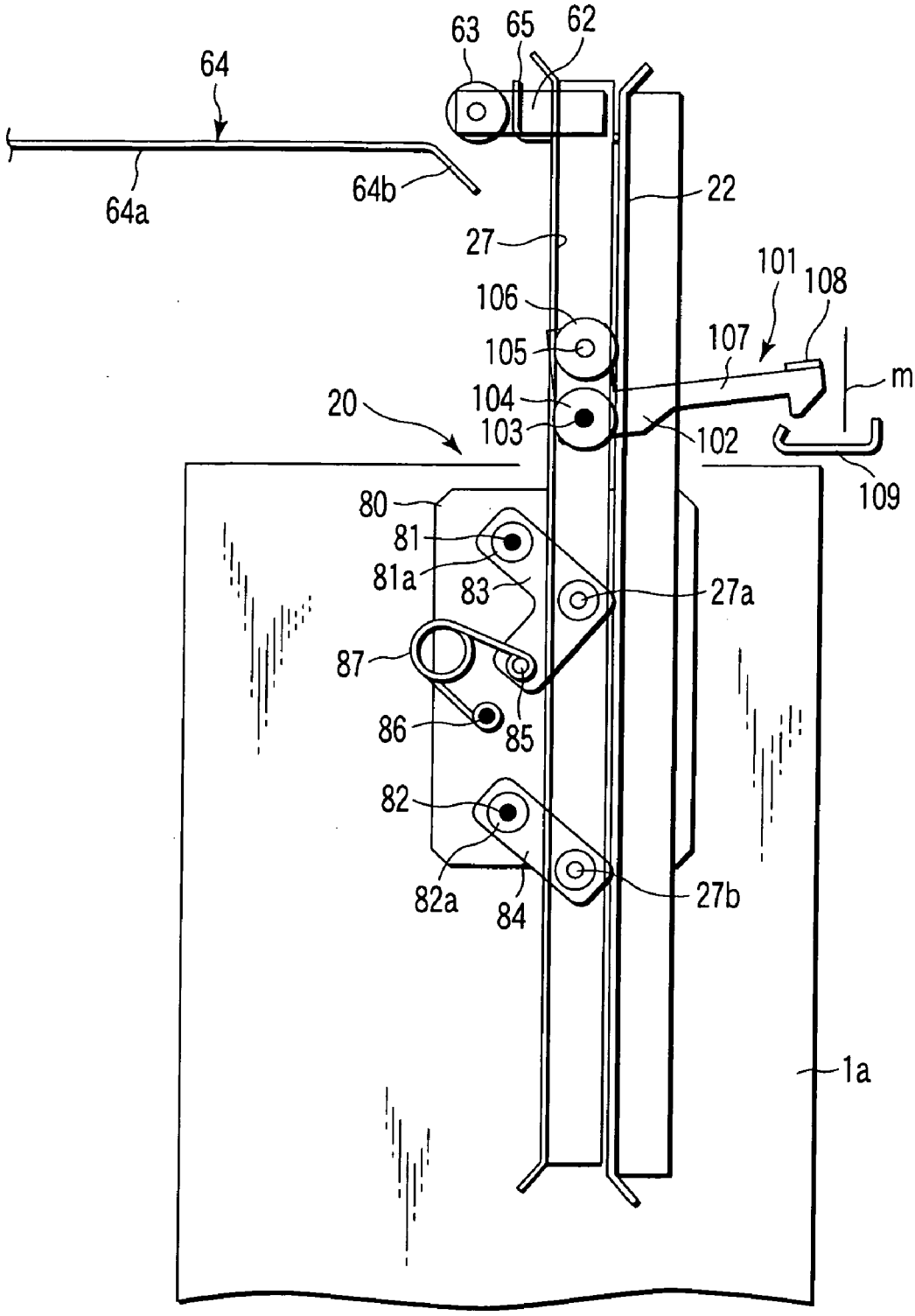
FIG. 20 is a diagram showing how the engaging device operates in a stage in which car doors of an elevator door apparatus of a fifth embodiment according to the present invention is being closed.

In the state shown in FIG. 20, when the car door 1*a* moves in the closing direction, the link plates 83 and 84 move rotationally clockwise around the shafts 81 and 82, respectively, against the elastic force of the helical torsion spring 87. After the neutral state in which the shafts 81, 85, and 86 are lined up straight, a direction, in which the elastic force of the helical torsion spring 87 acts, is switched by further moving the car door 1*a* in the closing direction. As a result, the link plates 83 and 84 are elastically urged clockwise around the shafts 81 and 82, respectively, under the elastic force of the helical torsion spring 87. When movable portions such as the link plates 83 and 84 reach the positions shown in FIG. 21, they abut against a mechanical stopper and are thus stopped.

Figure 21:
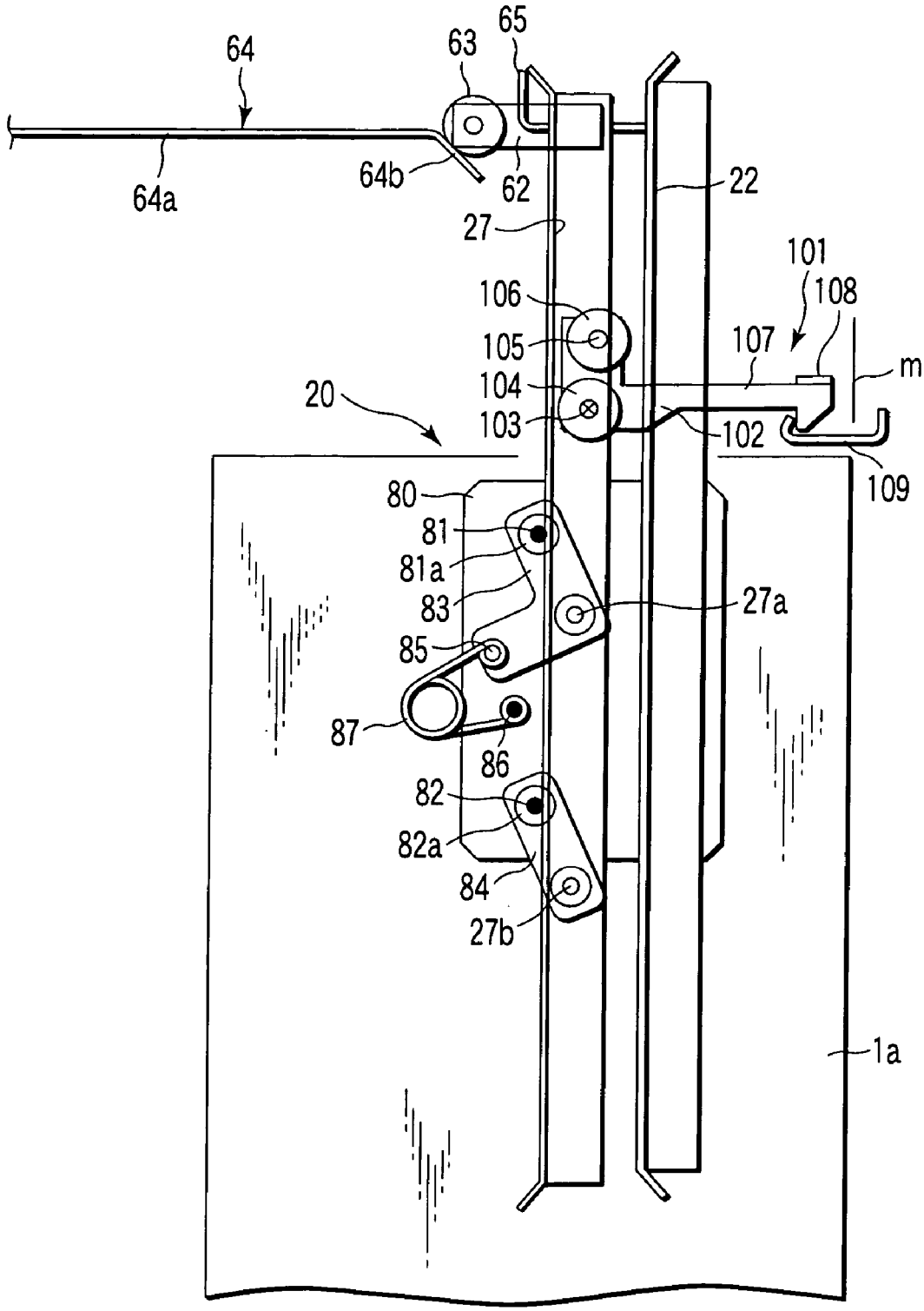
FIG. 21 is a diagram showing how the engaging device shown in FIG. 20 operates in a final stage.

In the state shown in FIG. 21, the distance between the fixed vane 22 and the movable vane 27 widens to disengage the car door 1*a* from the hall doors 100*a* and 100*b*. During the process between the state shown in FIG. 20 and the state shown in FIG. 21, the cam roller 63 remains out of contact with the cam plate 64 as described in the third embodiment.

If the elevator door apparatus is to be opened, the hall door is unlocked, because the fixed vane 22 abuts against the engaging roller 106 as in the case of the first to fourth embodiments. The cam roller 63 climbs up onto the horizontal portion 64*a* of the cam plate 64 through the inclined portion 64*b*. The movable vane 27 is then lifted up. As a result, the link plate 83 rotates counterclockwise, and the direction, in which the elastic force of the helical torsion spring 87 acts is switched again. Since the link plate 83 is elastically urged counterclockwise, the first engaging roller 104 and the second engaging roller 106 are sandwiched between the movable vane 27 and the fixed vane 22. This causes the car door 1*a* to be firmly engaged with the hall door. Further, the movable vane 27 is prevented from moving toward the fixed vane 22 while the car door 1*a* is closed by causing the cam stop portion 65 is provide in the elevator door apparatus 10. The helical torsion spring 87 can be used in place of the spring unit 33; it functions similarly to the sprint unit 33.

By thus replacing the spring unit 33, shown in the first to fourth embodiments, with the torsion spring 87, having the simple structure, it is possible not only to produce the same effects as those described in the first to fourth embodiments but also to reduce the number of parts required.

The present embodiment uses the helical torsion spring 87. However, it is possible to use a leaf spring or other springs. Further, although not illustrated, a tension spring can be used to stably maintain the state in which the hall door is engaged with the car door and the state in which the hall door is disengaged from the car door.

Sixth Embodiment

Figure 22:
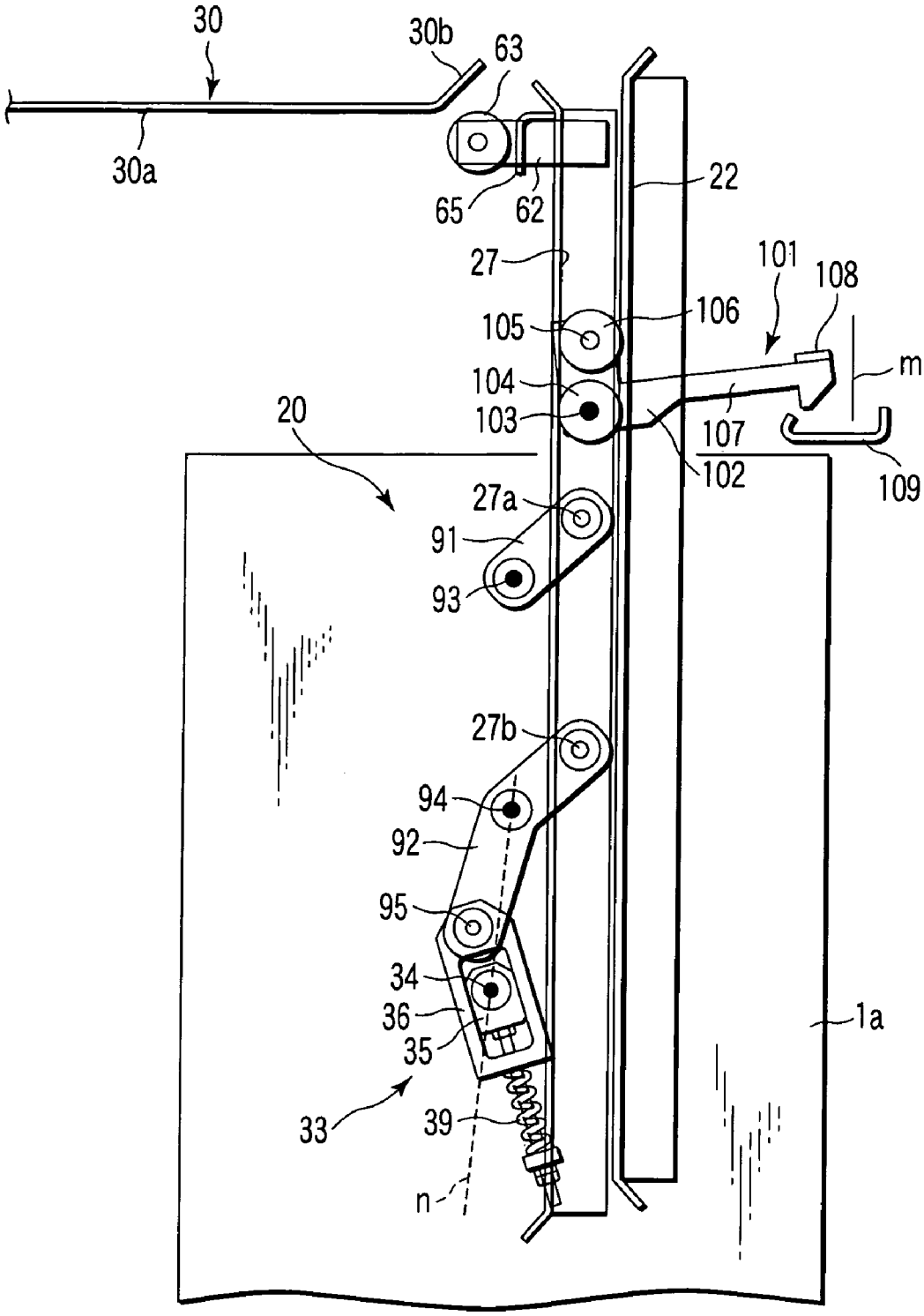
FIG. 22 is a diagram showing how the engaging device operates in a stage in which car doors of an elevator door apparatus of a sixth embodiment according to the present invention is being closed.
Figure 23:
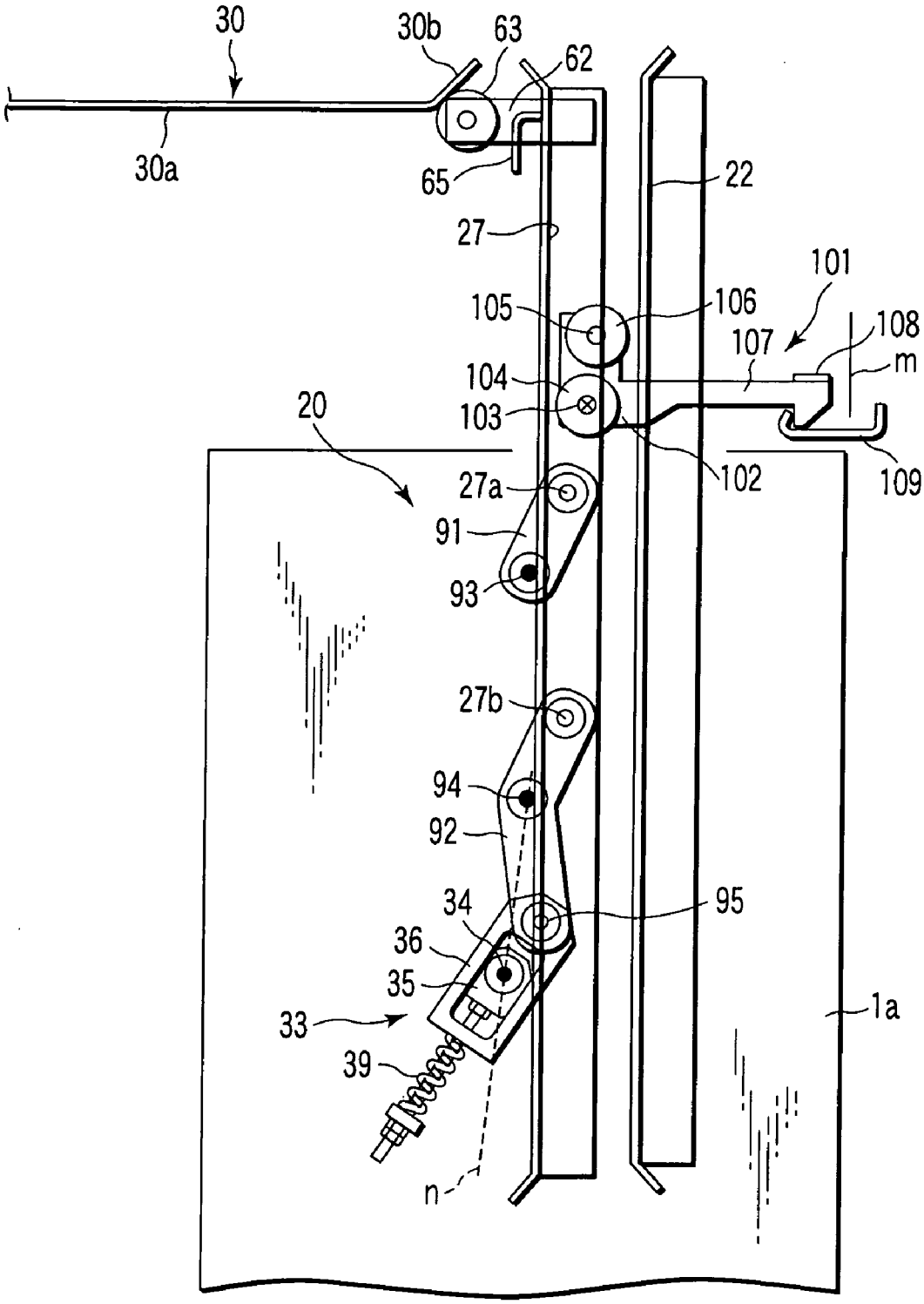
FIG. 23 is a diagram showing how the engaging device shown in FIG. 22 operates in a final stage.

An elevator door apparatus according to a sixth embodiment will be described with reference to FIGS. 22 and 23. The link mechanism of the engaging device 20 differs from that in the first to fifth embodiments. The link mechanism is composed of the movable vane 22 and link plates 91 and 92 and shaped like a parallelogram as shown in FIG. 22. The link plate 91 is rotationally movably assembled to the shaft 93. The link plate 92 is rotationally movably assembled to the shaft 94. The shafts 93 and 94 are fixed to the base plate. The base plate is fixed to the car door 1*a*.

The link plates 91 and 92 are connected to the movable vane 27 using the shafts 27*a* and 27*b*. The link plates 91 and 92 are combined with the movable vane 27 so as to extend upward from the shafts 93 and 94, respectively. The direction in which the link plates 91 and 92 are mounted is different from that in the elevator door apparatus 10 according to the first to fifth embodiments.

The upper end of the spring unit 33 is rotationally movably connected to a shaft 95 fixed to the lower end of the link plate 92. The spring unit 33 elastically urges the shaft 95 in a direction in which the shaft 95 moves away from the shaft 34, that is, in a direction in which the link plate 92 moves rotationally clockwise around the shaft 94 in FIG. 22.

In the state shown in FIG. 22, when the car door 1*a* moves in the closing direction, the link plates 91 and 92 move rotationally counterclockwise against the force of the spring unit 33. FIG. 23 shows that the car door 1*a* further moves in the closing direction after the neutral state in which the shafts 94 and 95 are lined up straight along a dotted line n. After the neutral state, the direction in which the elastic force of the spring unit 33 acts is reversed around the shaft 94. In FIG. 23, the link plates 91 and 92 are elastically urged counterclockwise around the shaft 94. Consequently, the movable vane 27 moves away from the fixed vane 22. The lock mechanism 101 is to be activated, when the distance between the fixed vane 22 and the movable vane 27 is widened. The car door 1*a* is thus disengaged from the hall doors 100*a* and 100*b*. The link mechanism abuts against the mechanical stopper (not shown) and is thus stopped as shown in FIG. 23.

As described above, in the elevator door apparatus 10 according to the present embodiment, the spring unit 33 can stably maintain either the state in which the hall door 100*a* is engaged with the car door 1*a* or the state in which the hall door 100*a* is disengaged from the car door 1*a*. The present embodiment produces the same effects as those of the other embodiments.

Seventh Embodiment

An elevator door apparatus according to a seventh embodiment will be described with reference to FIGS. 24 and 25. In the present embodiment, the engaging device 20 of the elevator door apparatus comprises the base plate 80, the fixed vane 22, the movable vane 27, link plates 111 and 112, a helical torsion spring 110, and a cam mechanism. The base plate 80 has shafts 93, 94, and 115 and is fixed to the car door 1*a*. The movable vane 27 comprises the shafts 27*a* and 27*b*. The link plate 111 is rotationally movably connected to the shafts 93 and 27*a*. The link plate 112 is rotationally movably connected to the shafts 94 and 27*b*.

Figure 24:
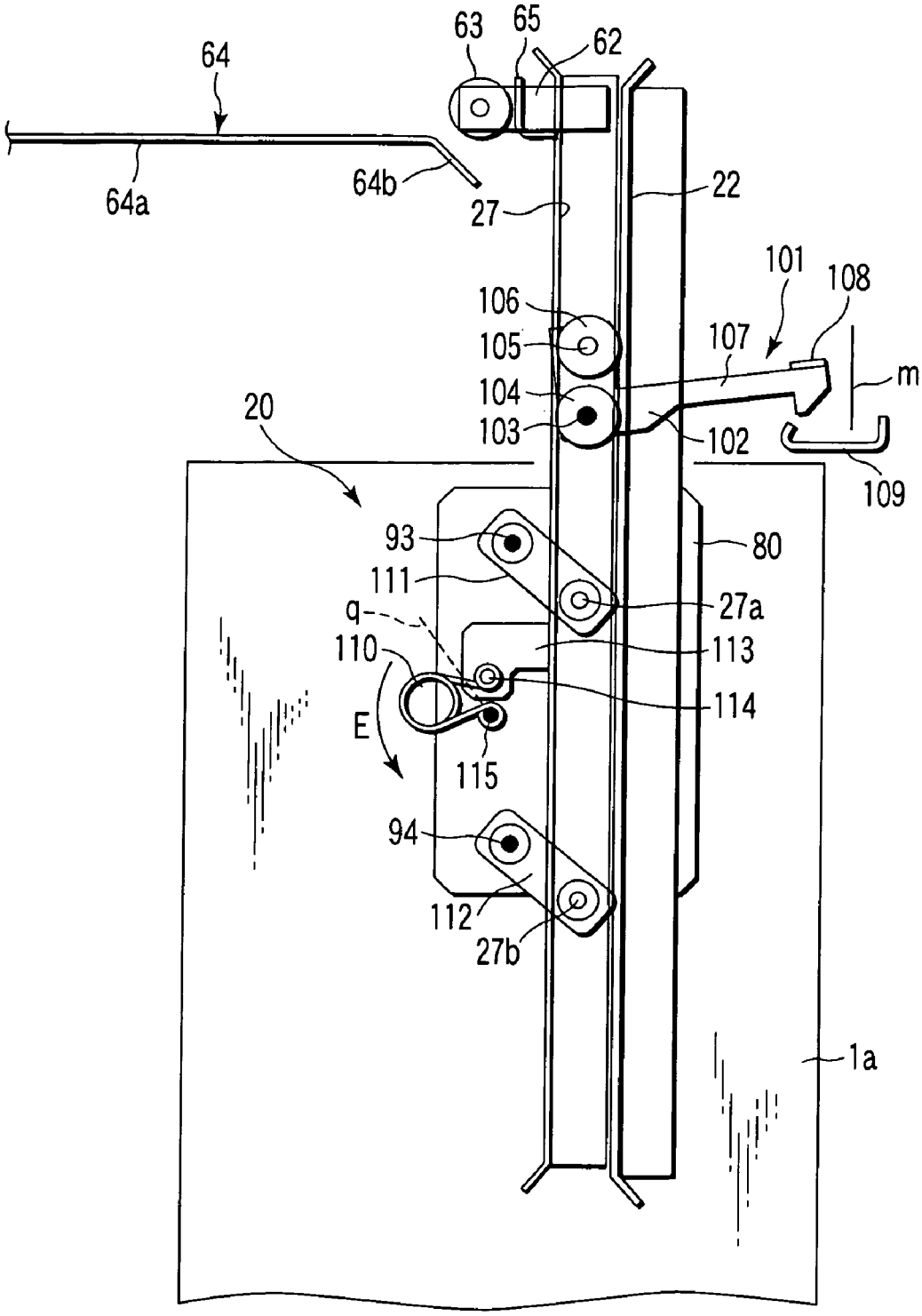
FIG. 24 is a diagram showing how the engaging device operates in a stage in which car doors of an elevator door apparatus of a seventh embodiment according to the present invention is being closed.
Figure 25:
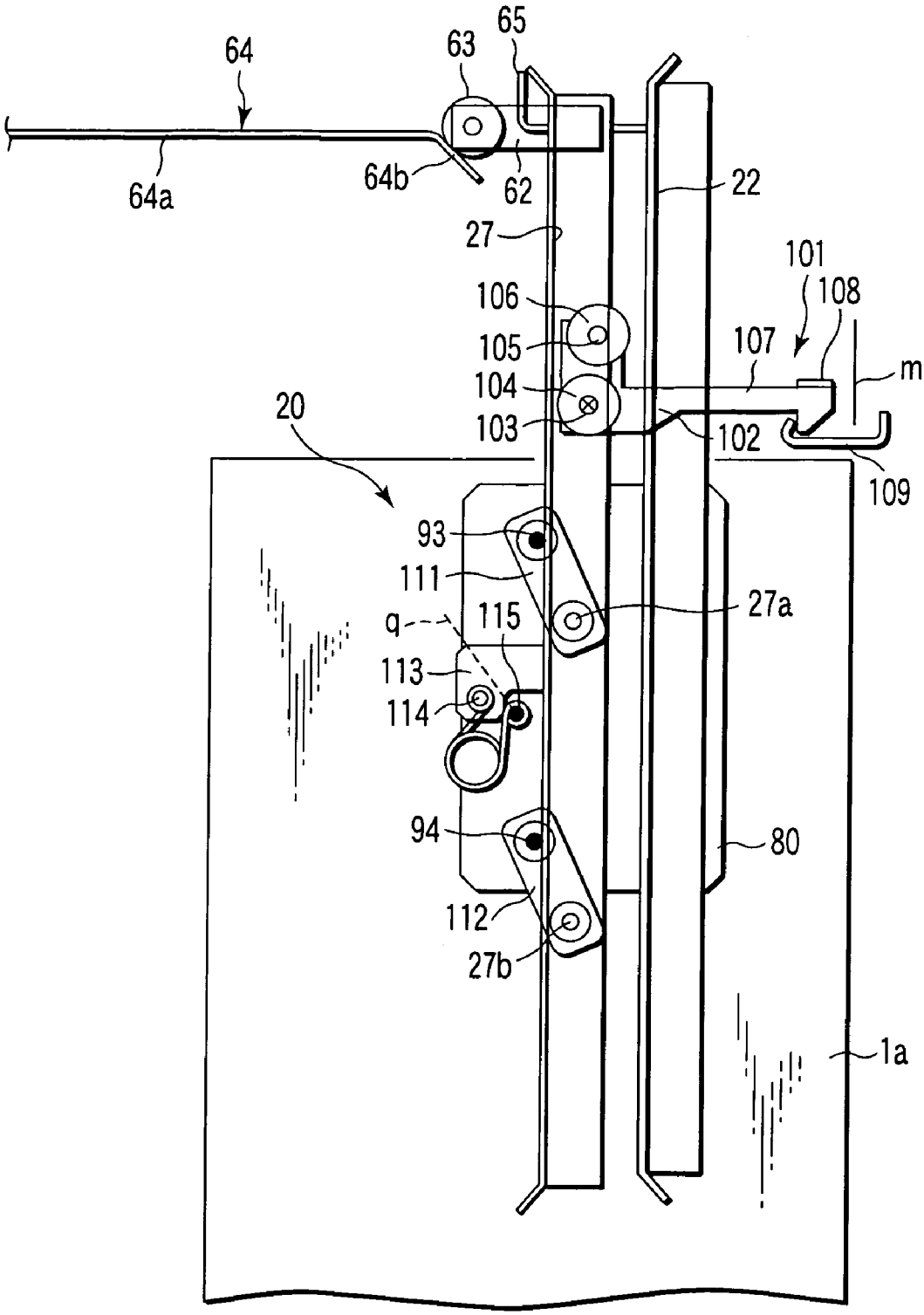
FIG. 25 is a diagram showing how the engaging device shown in FIG. 24 operates in a final stage.

As shown in FIG. 24, the movable vane 27 has a plate 113 to which the shaft 114 is attached. In the engaging device 20, one end of the helical torsion spring 110 is connected to the shaft 115. The other end of the helical torsion spring 110 is connected to the shaft 114 instead of the link plate 111 or 112. The helical torsion spring 110 elastically urges the link plates 111 and 112 in a direction in which the shaft 114 moves away from the shaft 115, that is, in a direction in which the link plates 111 and 112 move rotationally counterclockwise around the shafts 93 and 94, respectively, in FIG. 24.

In the state shown in FIG. 24, the engaging device 20 engages the car door 1*a* with the hall door 100*a*. In this state, when the car door 1*a* moves in the closing direction, the helical torsion spring 110 moves rotationally around the shaft 115 in the direction of arrow E in FIG. 4. Then, the helical torsion spring 110 is maximally deformed when the shaft 114 aligns with a dotted line q.

Once the shaft 114 has passed beyond the dotted line q, the elastic force of the helical torsion spring 110 reverses the direction of a force acting on the link plate 111 to rotate the link plate 111 around the shaft 93, that is, the direction of a force acting on the link plate 112 to rotate the link plate 112 around the shaft 94. In other words, the state shown in FIG. 25 is established. Thus, the link plates 111 and 112 are elastically urged clockwise, and then the movable vane 27 moves away from the fixed vane 22.

Further, a part of the movable portion which is interlocked with the movable vane 27 abuts against the mechanical stopper (not shown). The link mechanism is thus stopped as shown in FIG. 25. When the car door 1a is completely closed as shown in FIG. 25, the lock mechanism 101 is activated by widening the distance between the fixed vane 22 and the movable vane 27. The car door 1*a* is thus disengaged from the hall door 100*a*.

As in the case of the first to sixth embodiments, whether the car door 1*a* is engaged with or disengaged from the hall door 100*a*, the position of the movable vane 27 is stably maintained by the urging force of the helical torsion spring 110. Therefore, the present embodiment produces effects similar to those of the first to sixth embodiments.

Eighth Embodiment

An elevator door apparatus according to an eighth embodiment will be described with reference to FIGS. 26 and 27. According to the present embodiment, the engaging device 20 comprises the helical torsion spring 110 in the space between the base plate 80 and the movable vane 27. The base plate 80 has a shaft 117. The movable vane 27 has a shaft 116. One end of the helical torsion spring 110 is connected to the shaft 116. The other end is connected to the shaft 117.

Thus, the present embodiment differs from the seventh embodiment only in that the helical torsion spring 110 is connected directly to the movable vane 27. Accordingly, in the state shown in FIG. 26, when the car door 1*a* moves in the closing direction, the lock mechanism 101 is activated to release the engaging device 20 as in the case of the seventh embodiment. Then, the state shown in FIG. 27 is established.

Figure 26:
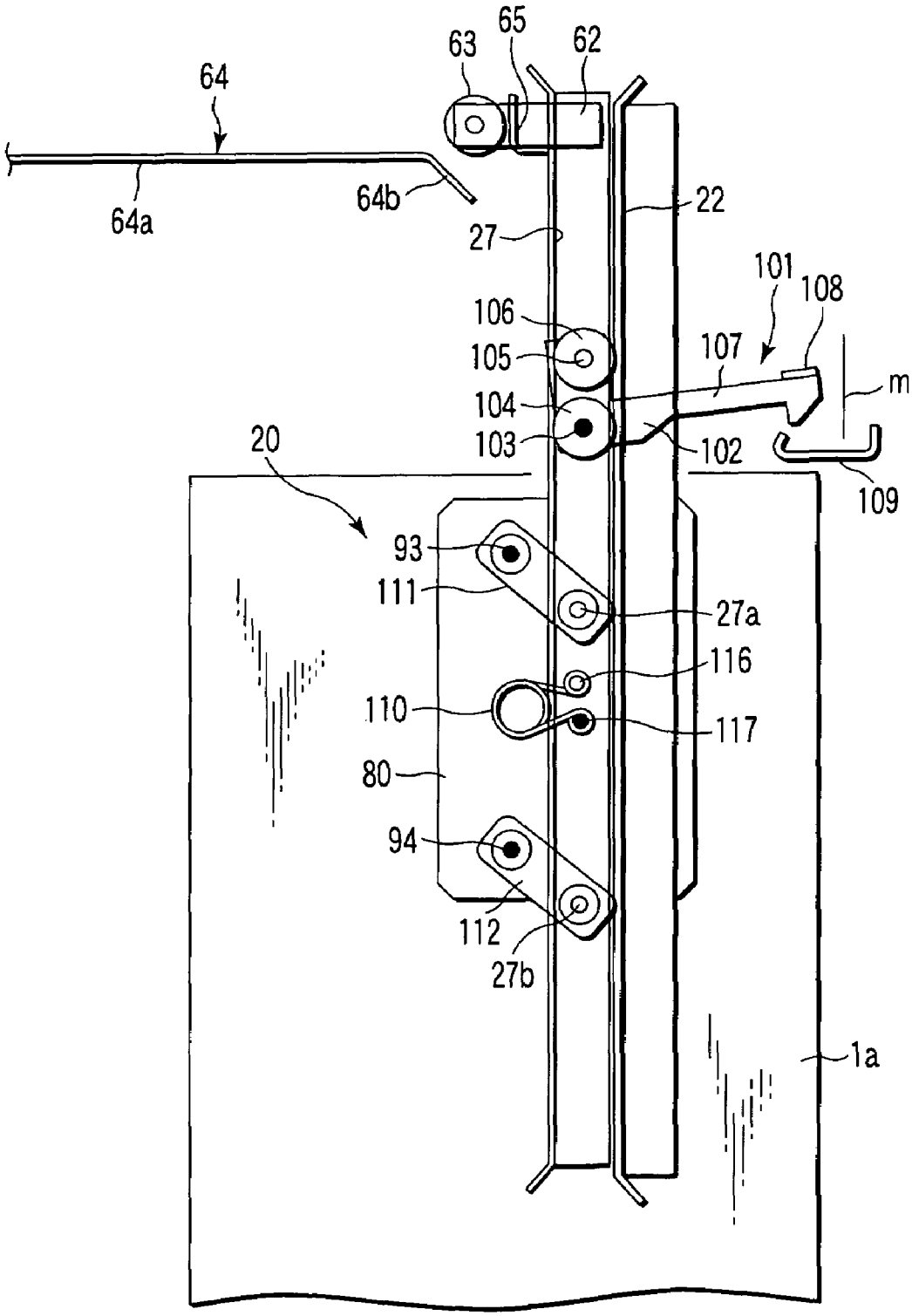
FIG. 26 is a diagram showing how the engaging device operates in a stage in which car doors of an elevator door apparatus of an eighth embodiment according to the present invention is being closed.
Figure 27:
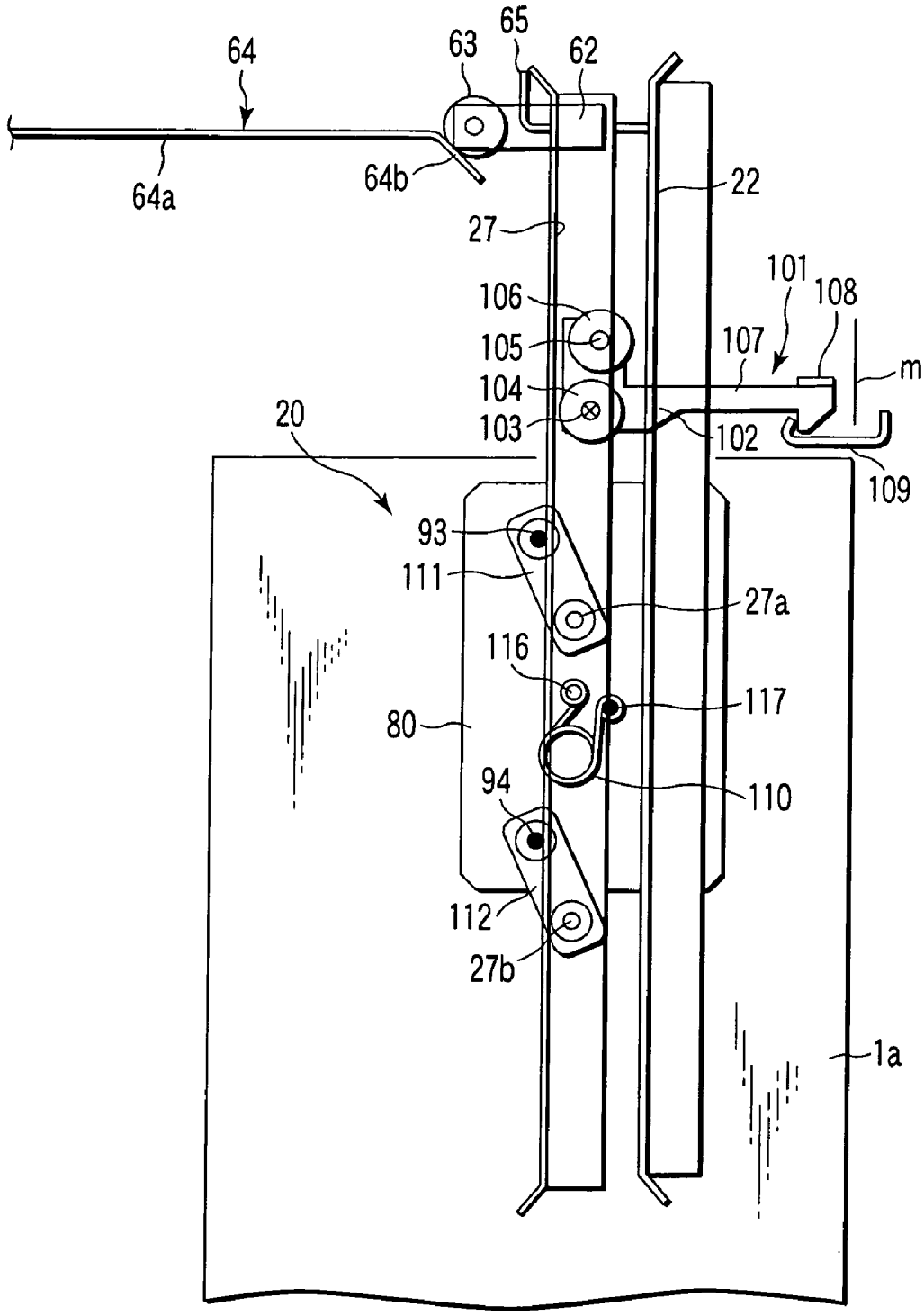
FIG. 27 is a diagram showing how the engaging device shown in FIG. 26 operates in a final stage.

With the engaging device 20 configured as described above, either in the state in which the car door 1*a* is engaged with the hall door 100*a* as shown in FIG. 26 or in the state in which the car door 1*a* is disengaged from the hall door 100*a* as shown in FIG. 27, the position of the movable vane 27 is stably maintained by the urging force of the helical torsion spring 110. Therefore, the present invention products the same effects as those of the first to seventh embodiments. Moreover, the engaging device 20 according to the present embodiment serves to reduce the number of parts required. Consequently, the structure of the apparatus can be simplified.

The present embodiment uses the helical torsion spring. However, it is possible to use the above spring unit or leaf spring. Alternatively, attenuation applying means such as the above shock absorber can be attached to the apparatus.

Ninth Embodiment

An elevator door apparatus according to a ninth embodiment will be described with reference to FIGS. 28 and 29. In the elevator door apparatus described in the first to eighth embodiments, the fixed vane 22 and movable vane 27 of the engaging device 20 sandwich the two engaging rollers 104 and 106 between themselves, the engaging rollers 104 and 106 being provided in the hall door 100*a*.

In contrast, in the ninth embodiment, the engaging rollers are spaced away from each other in the horizontal direction. When the elevator reaches a floor, the fixed vane and the movable vane get into a gap between the engaging rollers. The hall door and the car door are engaged by the operation of widening the distance between the fixed vane and the movable vane. Components having the same functions as those of the components described in the first to eighth embodiments are denoted by the same reference numerals, with their description omitted.

Figure 28:
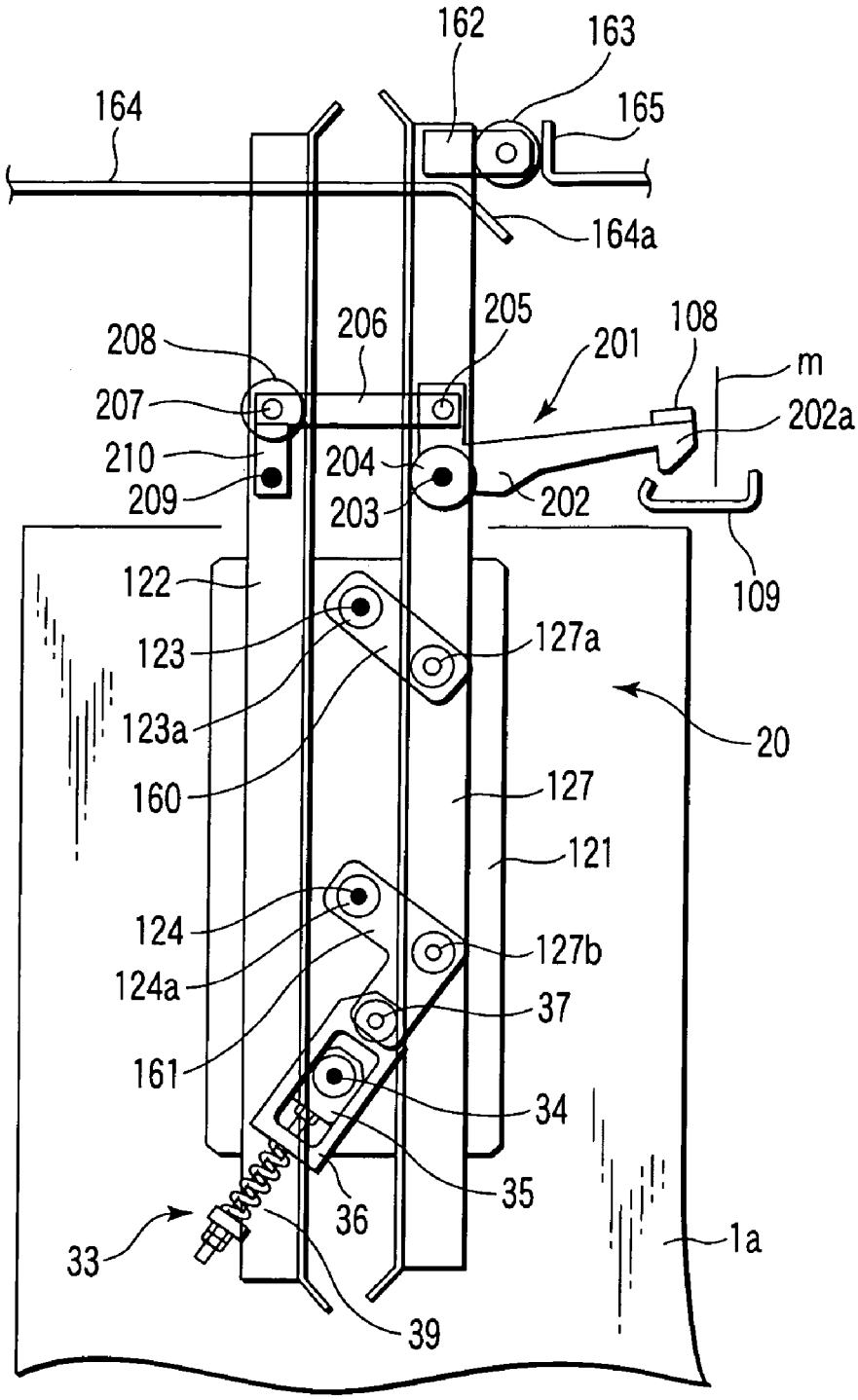
FIG. 28 is a diagram showing how the engaging device operates in a stage in which car doors of an elevator door apparatus of a ninth embodiment according to the present invention is being closed.
Figure 29:
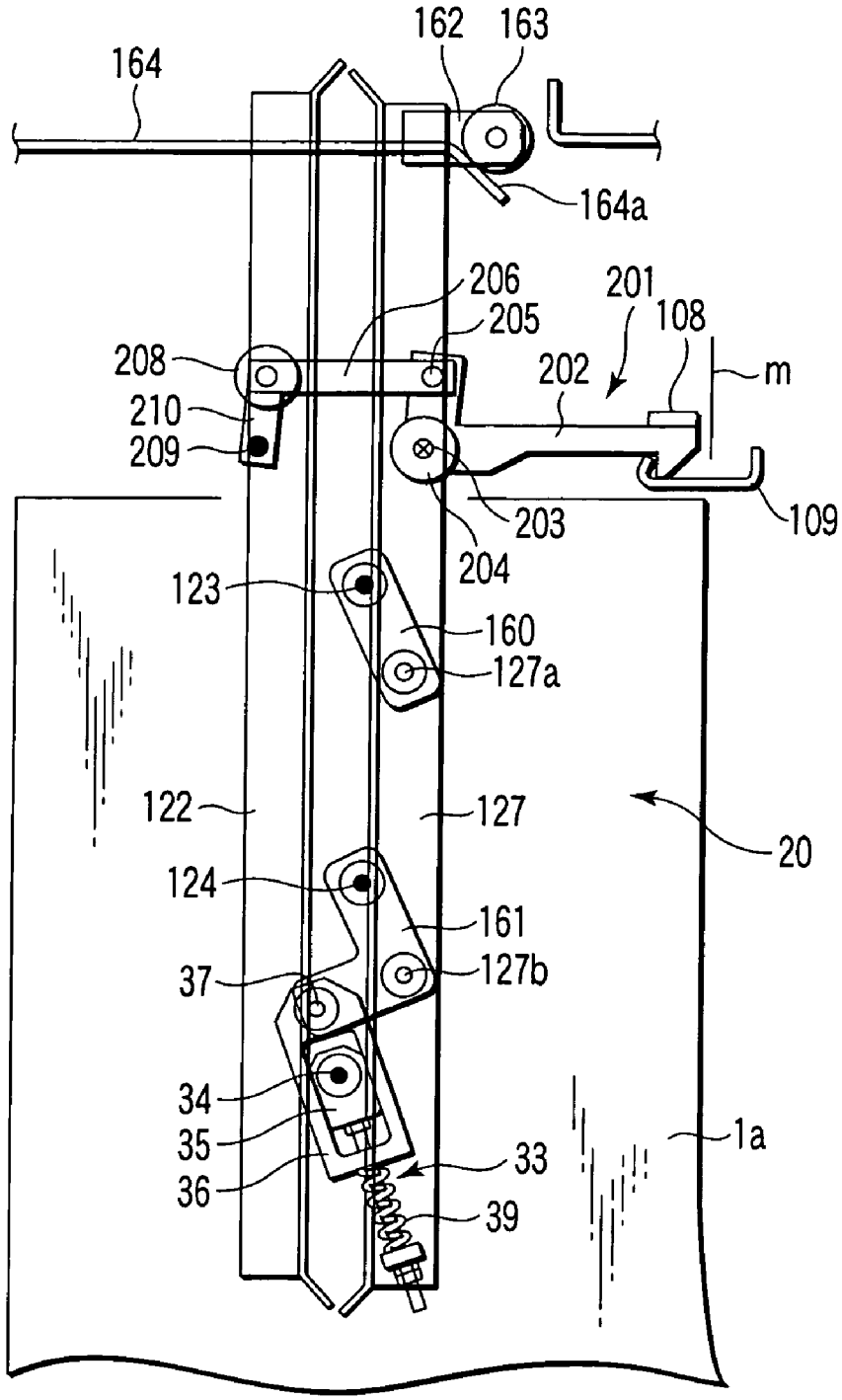
FIG. 29 is a diagram showing how the engaging device shown in FIG. 28 operates in a final stage.

FIG. 28 shows the state of the car door and engaging device observed when only the hall door is closed. FIG. 29 shows that the car door is also completely closed and that the lock mechanism has been activated to release the engaging device. The engaging device of the elevator door apparatus comprises a base plate 121, a fixed vane 122, a movable vane 127, link plates 160 and 161, a cam mechanism, the spring unit 33, a first engaging roller 204, and a second engaging roller 208.

The base plate 121 is fixed to the car door 1*a*. The base plate 121 has shafts 123 and 124. The link plate 160 is rotationally movably assembled to the shaft 123 via a bearing 123*a*. The link plate 161 is rotationally movably assembled to the shaft 124 via a bearing 124*a*. The movable vane 127 comprises shafts 127*a* and 127*b*. The link plate 160 is connected to the movable vane 127 via the shaft 127*a*. The link plate 161 is connected to the movable vane 127 via the shaft 127*b*.

As a result, the link plates 160 and 161 and the movable vane 127 constitute a parallelogrammic link mechanism. The spring unit 33 is attached to the bottom of the link plate 161 as in the case of the other embodiments. Further, the fixed vane 122 is fixed to the car 1*a* or the base plate 121 opposite the movable vane 127.

The cam mechanism is composed of a mounting plate 162, a cam roller 163, and a cam plate 164. The mounting plate 162 is provided at the top of the movable vane 127. The cam roller 163 is rotationally movably supported by the mounting plate 162. The cam plate 164 fixed to the frame member of the car door apparatus. An inclined portion 164*a* is formed at an end of the cam plate 164 which is closer to the door stop position m. When the car door 1*a* moves, the cam roller 163 abuts against the inclined portion 164*a*. Further, a cam stop portion 165 is provided away from the cam plate 164 and closer to the door stop portion.

A lock mechanism 201 of the elevator door apparatus is provided in the hall door. The lock mechanism 201 comprises a hook 202, a link bar 206, and an arm rod 210. The hook lever 202 is bent like the letter L and is rotationally movably supported by the shaft 203 at the bent portion. The first engaging roller 204 of the engaging device 20 is rotationally movably installed around the shaft 203 as a first engaging member. The hook lever 202 has a hook 202*a* extending laterally from the bent portion and having a key-shaped tip. Further, the hook lever 202 has a shaft 205 at an end of an arm extending upward from the bent portion.

The link bar 206 is connected to the hook lever 202 via the shaft 205 and to the arm rod 210 via the shaft 207. A second engaging roller 208 of the engaging device 20 is rotationally movably installed around the shaft 207 as a second engaging member. The arm rod 210 is rotationally movably attached to the hall door via a shaft 209. The arm of the hook lever 202, the link bar 206, and the arm rod 210 constitute a parallelogrammic link mechanism having the shafts 203, 205, 207, and 209 as joining portions. Further, the hook 202*a* of the hook lever 202 is caught in the engaging portion 109 provided in the frame member of the hall door apparatus.

The fixed vane 122 and the movable vane 127 get into a gap between the first engaging roller 204 and the second engaging roller 208, when the car moves. The fixed vane 122 is placed on the second engaging roller 208. The movable vane 127 is placed on the first engaging roller 204.

In the state shown in FIG. 28, the fixed vane 122 and the movable vane 127 are engaged with the first engaging roller 204 and the second engaging roller 208, respectively, so as to push the first engaging roller 204 and second engaging roller 208 open from between them. The spring unit 33 urges the link plate 161 counterclockwise around the shaft 124. As a result, the movable vane 127 is urged away from the fixed vane 122. The first engaging roller 204 and the second engaging roller 208 are urged in opposite directions so as to move away from each other. Consequently, the hook 202*a* of the hook lever 202 is detached from the engaging portion 109.

FIG. 28 shows a state observed immediately after the hall door has been completely closed. In this state, the positions of the shafts 203 and 209 constitute immobile points with respect to the door stop position m. In the state shown in FIG. 28, when the car door 1*a* moves in the closing direction, the movable vane 127 approaches the fixed vane 122. As a result, the hook 202*a* engages with the engaging portion 109. The link plates 160 and 161 move rotationally clockwise around the shafts 123 and 124, respectively. The spring unit 33 moves rotationally counterclockwise around the shaft 34.

As the car door 1*a* is further closed, the distance between the fixed vane 122 and the movable vane 127 is narrowed by rotating the link plates 160 and 161. As a result, the engaging rollers 204 and 208 of the hall door are disengaged from the fixed vane 122 and movable vane 127, respectively. FIG. 29 shows the situation that the lock mechanism 201 activates after the car doors 1*a* and 1*b* have been completely closed, and the locking device 20 is released.

Now, description will be given of operations performed to open the elevator door apparatus. If the door apparatus is to be opened, then in the state shown in FIG. 29, the car door 1*a* starts to be opened as in the case of the first to eighth embodiments. Then, the fixed vane 122 abuts against the second engaging roller 208. Since the link bar 206 is pulled toward the second engaging roller 208, the hook lever 202 moves rotationally around the shaft 203. Hence the lock mechanism 201 of the hall door is released. Further, at the same time when the car door 1*a* starts to be opened, the cam roller 163 climbs up onto the cam plate 164 along the inclined portion 164*a*.

Thus, the movable vane 127 is lifted up. The link plates 160 and 161 move rotationally counterclockwise around the shafts 123 and 124, respectively. The rotational movement of the link plate 161 rotationally moves the spring unit 33 clockwise around the shaft 34. When the shaft 37 crosses the segment joining the shafts 124 and 34 together, the urging force of the compression spring 39 of the spring unit 33 urges the link plate 161 counterclockwise around the shaft 124.

As the movable vane 127 is pushed toward the door stop portion, the distance between the movable vane 127 and the fixed vane 122 is increased. The movable vane 127 and the fixed vane 122 are pressed against the first engaging roller 204 and the second engaging roller 208, respectively, so as to widen the distance between the first engaging roller 204 and the second engaging roller 208. The urging by the spring unit 33 causes the car door 1*a* and the hall door to be firmly engaged. The car door 1*a* and the hall door are thus driven in the opening direction.

Further, as in the case of the other embodiments, the cam stop portion 165 is provided. Accordingly, while the car door 1*a* is closed, the movable vane 127 is prevented from closing unnecessarily to the engaging roller 204.

According to the present embodiment, even the engaging device configured to push the engaging rollers open during engagement can produce exactly the same effects as those of the other embodiments. Alternatively, the attenuation applying means shown in the second embodiment may be provided in the spring unit 33 of the engaging device 20 according to the present embodiment. In the present embodiment, the lock mechanism 201 is composed of the parallelogrammic link mechanism. However, the lock mechanism 201 may have a different structure.

In the description of the above embodiments, the elevator door apparatus 10 has the double biparting door. However, the present invention can be carried out on a door apparatus consisting of a single swing door or two or more door panels.

In the above embodiments, the single engaging device is provided for the two door panels. However, it is possible to install a plurality of engaging devices in a door apparatus using large door panels owing to a large width.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

The present invention is allowed applying to an elevator door.

What is claimed is:

1. An elevator door apparatus including an engaging device for joining car doors with hall doors, and a lock mechanism for keeping the hall doors in a closed state, wherein the engaging device comprises:

a first engaging member provided in the hall door to transmit a driving force to the hall door;

a second engaging member provided in the hall door to move relative to the first engaging member to activate the lock mechanism;

a fixed vane provided at the car door and located on one side of the first and second engaging members, the fixed vane transmitting, to the second engaging member, the driving force applied in an opening direction of the car door, thereby releasing a locked state of the hall doors by the lock mechanism;

link plates rotatably provided on the car door, each of the link plates including a first end and a second end;

a movable vane rotatably attached to the first ends of the link plates, located on another side of the first and second engaging members, and movable in parallel with the fixed vane;

a spring mechanism coupled to one of the link plates and including a spring member which urges the movable vane toward and away from the fixed vane, the spring mechanism urging the movable vane toward the fixed vane via the one link plate when the car door is moved in a closing direction, thereby holding the first and second engaging members between the fixed vane and the movable vane, the spring mechanism reversing a direction of a force applied by the spring member to the movable vane via the one link plate to keep the movable vane away from the fixed vane, when the hall door has been closed and the car door is still being moved in the closing direction; and a cam mechanism rotatably attached to the second ends of the link plates, the cam mechanism rotating the link plates to move the movable vane toward the fixed vane against the force of the spring member, when the car door is moved from its closed state.

2. The elevator door apparatus according to claim 1, wherein the cam mechanism comprises:

a cam plate provided on a frame of the car door; and a cam roller which moves integrally with the movable vane, said cam roller is out of contact with the cam plate when the engaging device is inactivated as the car door moves in the direction in which the car door is closed.

3. A elevator door apparatus according to claim 1, further comprising limiting means preventing the moving vane from moving toward a side on which the engagement occurs when the car door has been closed to inactivate the engaging device.

4. The elevator door apparatus according to claim 1, wherein the spring mechanism further includes a block rotatably connected to the car door via a first shaft, and a block frame slidable with respect to the block and rotatably connected to the one link plate via a second shaft, the spring member elastically urging the first shaft and the second shaft away from each other.

5. The elevator door apparatus according to claim 4, wherein the spring member of the spring mechanism is one of a helical compression spring, a helical torsion spring, and a leaf spring.

6. An elevator door apparatus including sliding car doors which close an entrance of a car of an elevator; sliding hall doors which close an entrance of an elevator hall, a driving mechanism which drives each of the car doors; a lock mechanism which locks and closes each of the hail doors; and an engaging device which engages the car door with the hall door when the car reaches the elevator hall floor, to transmit a driving force of the car door to the hall door, said engaging device activates the lock mechanism responding to disengagement of the car door and the hall door; a leading edge of a door stop side of the hail door preceding a leading edge of a door stop side of the car door, when the car door and the hall door move in unison in a direction in which the doors are closed, wherein the engaging device comprises:

a first engaging member being provided in the hall door to transmit the driving force of the car door to the hall door;

a second engaging member being provided in the hall door and displaced relative to the first engaging member to activate the lock mechanism;

a fixed vane being fixed to the car door;

a movable vane being supported by the car door via a link mechanism so as to be movable in a direction approaching or leaving the fixed vane while keeping parallel to the fixed vane; said movable vane being maintained a relative position with the fixed vane so that the second engaging member is held in a position where the lock mechanism is released when the car door and the hall door move in a direction in which the doors are closed; said movable vane locking the hall doors activating the lock mechanism by disengaging from the first engaging member and the second engaging member to move parallel to the fixed vane when the hall doors abut against each other and are thus stopped;

a spring mechanism elastically urging the movable vane in a direction in which the movable vane engages with the first engaging member and the second engaging member, to maintain the engagement condition in that position when the movable vane engages with the first and second engaging members, and elastically urging the movable vane in a direction in which the movable vane releases from the engagement with the first engaging member and the second engaging member, to maintain the disengagement condition in that position when the engagement has been released; and a cam mechanism moving parallel the movable vane in association with the movement of the car door and against the force of the spring mechanism to place in a position where the movable vane engages with the first engaging member and second engaging member when the car door is to be moved in a direction in which the car door is opened, wherein the spring mechanism comprises:

a first shaft provided on the car door;

a second shaft provided on the link mechanism or the movable vane; and a spring member which elastically urges the first shaft and the second shaft in a direction in which the first shaft and the second shaft move away from each other.

7. The elevator door apparatus according to claim 6, wherein the cam mechanism comprises:

a cam plate provided on a frame of the car door; and a cam roller which moves integrally with the movable vane, said cam roller is out of contact with the cam plate when the engaging device is inactivated as the car door moves in the direction in which the car door is closed.

8. A elevator door apparatus according to claim 6, further comprising limiting means preventing the moving vane from moving toward a side on which the engagement occurs when the car door has been closed to inactivate the engaging device.

9. The elevator door apparatus according to claim 6, wherein the spring member of the spring mechanism is one of a helical compression spring, a helical torsion spring, and a leaf spring.

* * * * *